US009310173B2

(12) United States Patent
Bay

(10) Patent No.: US 9,310,173 B2
(45) **Date of Patent: *Apr. 12, 2016**

(54) HOLLOW TIP MULTIPOINT ARROWHEAD

(71) Applicant: Clean-Shot Archery, Inc., Kent, WA (US)

(72) Inventor: Larry R. Bay, Renton, WA (US)

(73) Assignee: Clean-Shot Archery, Inc., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/187,296

(22) Filed: Feb. 23, 2014

(65) Prior Publication Data

US 2014/0171238 A1 Jun. 19, 2014

Related U.S. Application Data

(63) Continuation of application No. 13/273,932, filed on Oct. 14, 2011, now Pat. No. 8,657,709, which is a continuation-in-part of application No. 12/757,401, filed on Apr. 9, 2010, now Pat. No. 8,251,845.

(60) Provisional application No. 61/168,105, filed on Apr. 9, 2009.

(51) Int. Cl.

| | |
|---|---|
| ***F42B 6/08*** | (2006.01) |
| ***F42B 12/36*** | (2006.01) |
| ***F41G 1/35*** | (2006.01) |
| ***F41G 1/467*** | (2006.01) |
| ***F42B 6/04*** | (2006.01) |

(52) U.S. Cl.

CPC ..... *F42B 12/365* (2013.01); *F41G 1/35* (2013.01); *F41G 1/467* (2013.01); *F42B 6/04* (2013.01); *F42B 6/08* (2013.01); *F42B 12/362* (2013.01)

(58) Field of Classification Search

CPC ..... F41G 1/467; F42B 6/04; F42B 6/08

See application file for complete search history.

(56) References Cited

U.S. PATENT DOCUMENTS

| | | | | |
|---|---|---|---|---|
| 3,641,675 | A | | 2/1972 | Funk, Jr. |
| 4,340,930 | A | * | 7/1982 | Carissimi ..... 362/204 |
| 4,547,837 | A | | 10/1985 | Bennett |
| RE32,123 | E | | 4/1986 | Knight |
| 4,621,817 | A | | 11/1986 | Musacchia |
| 5,134,552 | A | * | 7/1992 | Call et al. ..... 362/203 |
| 5,141,229 | A | * | 8/1992 | Roundy ..... 473/570 |
| 5,175,651 | A | | 12/1992 | Marron et al. |
| 5,419,050 | A | | 5/1995 | Moore |
| 5,634,278 | A | | 6/1997 | London |

(Continued)

OTHER PUBLICATIONS

U.S. Appl. No. 61/293,504, filed Jan. 8, 2010; 56 pages.

(Continued)

*Primary Examiner* — John Ricci

(74) *Attorney, Agent, or Firm* — Skaar Ulbrich Macari, P.A.

(57) ABSTRACT

An arrow system includes a hollow arrow shaft having a front end and a rear end. A nock is disposed on the rear end of the arrow shaft. An arrowhead disposed at the front end of the arrow shaft. The arrowhead has a forward tip end and a rearward shaft end. A light source is provided to the arrow and arranged to illuminate the nock. A battery is provided to the arrow and coupled to the light source. A flight data sensor is provided to the arrow. A microprocessor is provided to the arrow and coupled to the light source, the flight data sensor and the battery.

20 Claims, 27 Drawing Sheets

(56) References Cited

U.S. PATENT DOCUMENTS

| | | | | |
|---|---|---|---|---|
| 5,871,410 | A | 2/1999 | Simo et al. | |
| 6,005,719 | A | 12/1999 | Rando | |
| 6,027,421 | A | 2/2000 | Adams, Jr. | |
| 6,040,566 | A | 3/2000 | Rioland et al. | |
| 6,077,179 | A | 6/2000 | Liechty, II | |
| 6,123,631 | A | 9/2000 | Ginder | |
| 6,134,793 | A * | 10/2000 | Sauers | 33/265 |
| 6,165,086 | A | 12/2000 | Liechty, II | |
| 6,171,206 | B1 | 1/2001 | Liechty, II | |
| 6,258,000 | B1 | 7/2001 | Liechty, II | |
| 6,287,223 | B1 | 9/2001 | Liechty, II | |
| 6,287,224 | B1 | 9/2001 | Liechty, II | |
| 6,306,053 | B1 | 10/2001 | Liechty, II | |
| 6,366,344 | B1 | 4/2002 | Lach | |
| 6,390,642 | B1 * | 5/2002 | Simonton | 362/203 |
| 6,409,617 | B1 | 6/2002 | Armold | |
| 6,428,433 | B1 | 8/2002 | Liechty, II | |
| 6,428,434 | B1 | 8/2002 | Liechty, II | |
| 6,490,060 | B1 | 12/2002 | Tai et al. | |
| 6,526,666 | B1 | 3/2003 | Lastinger, Jr. | |
| 6,622,392 | B1 | 9/2003 | Bourget | |
| 6,743,128 | B2 | 6/2004 | Liechty, II | |
| 6,755,758 | B2 | 6/2004 | Liechty, II | |
| 6,758,774 | B2 | 7/2004 | Liechty, II | |
| 6,851,197 | B2 | 2/2005 | Terry et al. | |
| 6,997,716 | B2 | 2/2006 | Skala et al. | |
| 7,216,643 | B2 * | 5/2007 | Pellerite | 124/86 |
| 7,231,721 | B2 * | 6/2007 | Minica et al. | 33/265 |
| 7,241,236 | B1 | 7/2007 | Chen | |
| 7,313,871 | B2 | 1/2008 | Lines et al. | |
| 7,314,419 | B2 | 1/2008 | Grace, Jr. et al. | |
| 7,316,625 | B2 * | 1/2008 | Takahashi | 473/578 |
| 7,409,770 | B2 * | 8/2008 | Jones | 33/265 |
| 7,837,580 | B2 | 11/2010 | Huang et al. | |
| 7,927,240 | B2 | 4/2011 | Lynch | |
| 7,931,550 | B2 | 4/2011 | Lynch | |
| 7,972,230 | B2 | 7/2011 | Donahoe | |
| 7,993,224 | B2 | 8/2011 | Brywig | |
| 8,221,273 | B2 | 7/2012 | Donahoe | |
| 8,251,845 | B2 * | 8/2012 | Bay | 473/583 |
| 8,657,709 | B2 * | 2/2014 | Bay | 473/583 |
| 2002/0197584 | A1 | 12/2002 | Kendir et al. | |
| 2003/0063959 | A1 | 4/2003 | Kao | |
| 2004/0014010 | A1 | 1/2004 | Swensen et al. | |
| 2005/0278964 | A1 | 12/2005 | Minica et al. | |
| 2011/0172039 | A1 | 7/2011 | Donahoe et al. | |

OTHER PUBLICATIONS

U.S. Appl. No. 61/293,757, filed Jan. 11, 2010; 104 pages.

* cited by examiner 600
117
611
310 FPS
20 YRDS 600
614
602
521
515
510
512

600
617
611
605
602
608

600
614

915
916

Traditional Mode
(No Electronic Adjustments)

Automatic - Hunting Mode
(Adjusted for Broadheads)

Automatic - Practice Mode
(Adjusted for Field Points)

HOLLOW TIP MULTIPOINT ARROWHEAD

PRIORITY

This application is a continuation of U.S. patent application Ser. No. 13/273,932, filed Oct. 14, 2011, which is a continuation-in-part of U.S. patent application Ser. No. 12/757,401, filed on Apr. 9, 2010, now U.S. Pat. No. 8,251,845, which claims priority benefit of U.S. Provisional Patent Application No. 61/168,105, filed on Apr. 9, 2009, and the disclosures of each of the foregoing are hereby incorporated by reference herein in their entirety.

FIELD

The present invention relates to an arrow systems configured to acquire flight data, relay the data to an aiming system and adjust the electronic sights based upon the collected flight data.

BACKGROUND

Accurate aiming in archery/cross bow and bow hunting of game is highly desired. Efforts have been made to utilize lasers to assist the user in improving aiming accuracy. One such attempt is disclosed in U.S. Pat. No. 6,134,793 to Sauers. The '793 patent discloses a laser aided alignment system wherein a laser tip is placed on an arrow shaft and the user can adjust the bow's sights to correspond to the projection of the laser on a given target. However, the laser tip disclosed in the '793 patent is only for alignment of the bow sight. It is not for aiming a shot and is not for being shot from the bow as a projectile.

U.S. Pat. No. 7,231,721 to Minica et al. discloses a laser projecting arrowhead that can be shot as a projectile. However, the aperture through which the laser projects is offset from the center axis of the arrow. Thus, the laser beam projected on the target will not correspond to the exact spot that the tip of the arrow will first contact. The '721 patent also does not disclose any method or means for turning the laser beam on or off. Thus, the battery may be more quickly drained and the beam could be unintentionally aimed in potentially dangerous directions, such as at aircraft or other persons, while the user is on the move.

Other attempts to improve sighting relate to the sighting system. Archery sights today typically include a mechanical device mounted on a bow that has one or more pins that an archer looks across at a target to properly aim the bow. Sometimes the pins include an optic fiber that illuminates to make the pin stand out in the archer's view. In addition, some sights include a peep sight mounted to the bowstring that gives the archer two points to align, one on the bowstring and one on the sight mounted to the bow. This typically improves sighting accuracy up to 20%. The angle at which an archer holds a bow to hit a target varies based on the distance of the archer from the target and the speed of the bow (e.g., in feet per second). Sights often account for this by included several mechanical pins, each dedicated to a particular range (e.g., 10-25 yards, 25-50 yards, and so forth).

Unfortunately, modern sights have several drawbacks. For example, they are often heavy mechanical devices that weigh down the bow and increase archer fatigue, which may decrease shot accuracy over time. In addition, fiber optic pins often bend or break, resulting in decreased accuracy and ultimately replacement of the sight. Moreover, even upon making a great shot, an archer often has difficulty locating the arrow. Not only may the arrow have strayed from where the archer aimed it, but the arrow may also have hit an animal or other moving target that changes position after the shot. Also, the archer is unable to adjust the sights with precision and in real time to match the flight performance of the actual arrow.

For example, there have been several suggested solutions that employ an augmented reality display that can impose over a generated view of the downrange target with, at least, an appropriate reticule superimposed over the display of the downrange target for the purpose of suitably isolating and marking the target without reference to an actual hardware embodiment of pins or, alternately, a network of fine lines, wires, or the like placed in the focus at the eyepiece of an optical instrument placed at the focus. For example, U.S. Pat. No. 7,162,806 entitled "Video Sighting System' granted to Swiggart on Jan. 16, 2007 envisions a video display and camera on a single mount such that the video display simply portrays what would be ordinarily visible to the eye from the general area of the rest. By overlaying mechanical pins, the sight performs much as it might without the video system.

Therefore, there remains a need to provide an improved arrow sighting system.

SUMMARY

The present disclosure teaches various example embodiments that address certain disadvantages in the prior art. An arrow, arrowhead and method of shooting an arrowhead are disclosed. In one example embodiment, an arrowhead includes a body. The body includes an internal cavity. A plurality of blades extend outwardly from the body. A sharpened tip extends forwardly from the body, with the tip having a center axis, and an aperture formed in the tip that extends outward along the center axis of the tip. A battery housing extends rearwardly from the body and includes a rearwardly extending threaded portion. The threaded portion includes a hole defined longitudinally therethrough. The threaded portion is sectioned longitudinally into first and second halves with a slot defined between the first and second halves. A battery is disposed in the battery housing. A front laser diode is disposed in the internal cavity of the body. The front laser diode is arranged so that the laser beam emitted by the diode projects forward from the arrowhead through the aperture in the tip. The laser beam is coaxial with the center axis of the tip.

In another example embodiment, an arrow is provided. The arrow includes a hollow shaft having a front end and a rear end. A nock is disposed on the rear end of the shaft. An arrowhead is disposed at the front end of the shaft. The arrowhead includes a body having a forward end and a rearward end. It also includes a tip disposed on the forward end of the body. The tip includes a plurality of sharpened points and cutting edges. The arrowhead further includes a housing disposed on the rearward end of the body. The housing including a rearwardly extending threaded portion. The threaded portion is sectioned longitudinally into first and second halves with a slot defined between the first and second halves.

In a further example embodiment, a method of shooting an arrow is provided. The method includes indexing the arrowhead to the plurality of vanes by tightening a set screw disposed in a portion of the arrowhead. A magnet is disposed on the bow. The arrow is engaged with the bow and drawn back until a forward facing laser beam in the arrowhead turns on in response to a hall effect sensor sensing the presence of the magnet. The forward facing laser beam is turned off when the hall effect sensor does not sense the presence of the magnet.

In certain embodiments, the archery sighting system solves several problems for archers and improves shot accuracy. In some exemplary embodiments, the system captures the shot on digital video. One embodiment includes a range finder with slope detect technology to aid the archer in selecting the proper distance to the target even with inclined and declined topography. In another exemplary embodiment, a chronograph determines the speed of the arrow (e.g., in feet per second) to help tune the bow automatically. In additional embodiments, a display of the sighting system includes touch screen capabilities and electroluminescent technology to allow the archer to see-through the display. The display automatically adjusts an electronic dot based on the speed of the bow and the distance to the target. A digital camera with zoom capabilities captures video footage of the shot. The arrow for the sighting system includes a forward-mounted laser to illuminate the target with a built in 3-axis accelerometer to automatically turn the arrow on and off. The rear section of the arrow or (nock) illuminates after the shot to aid the archer in retrieving the arrow. In some embodiments, the rear facing LED also includes an IR transmitter to wirelessly send the flight information back to a separate receiver. The hunting blades can be removed to allow the archer to use the sighting system for practice, 3D/traditional archery tournaments, and small game hunting.

In aspects the present invention comprises an archery sighting system and method for placing a reticule on a display. The system in certain example embodiments includes a housing mounted in fixed relation to a bow. The housing includes a rangefinder to generate a target distance signal indicative of a target distance between the bow and a target. A display is configured to depict a reticule. A chronograph generates a bow speed indicating a bow speed at which an arrow leaves the bow. A processor receives a bow speed signal from the chronograph, a range signal from the rangefinder. In response to the signals, the processor generates a reticule pattern on the display, the reticule is positioned to indicate an attitude of the bow necessary for an arrow released from the bow at the bow speed to strike a target at the target distance.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
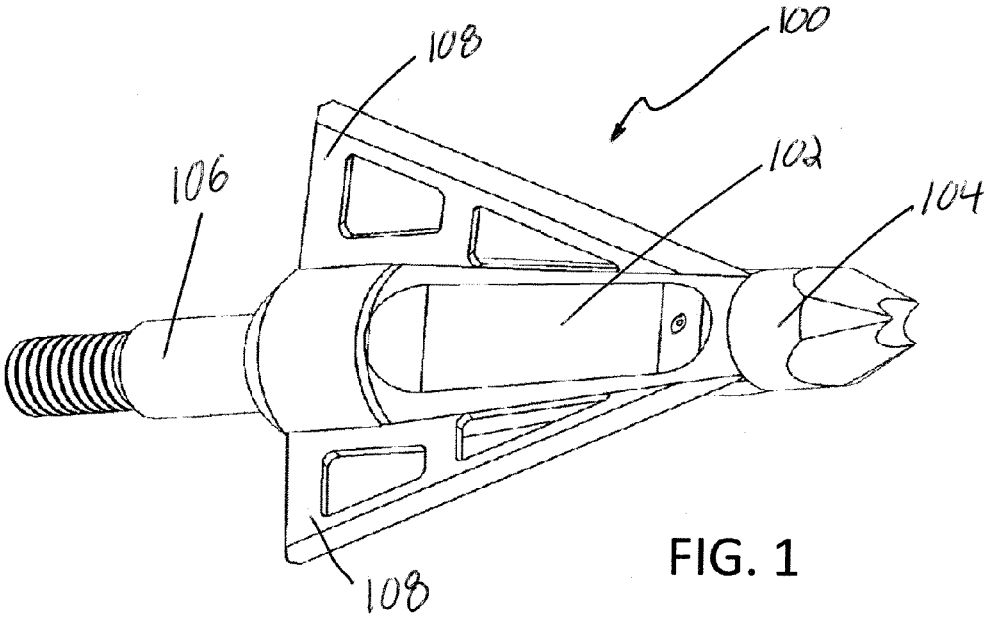
FIG. 1 is a perspective view of an arrowhead according to an example embodiment of the present invention.
Figure 2:
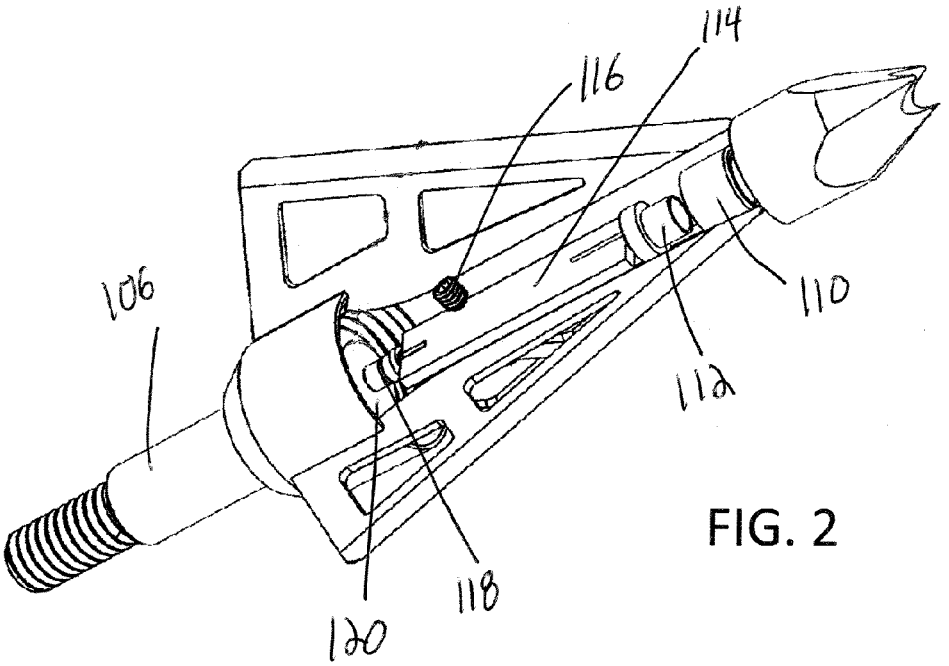
FIG. 2 is a cutaway perspective view of an arrowhead according to an example embodiment of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION

In the following description, the present invention will be explained with reference to example embodiments thereof. However, these example embodiments are not intended to limit the present invention to any specific environment, applications or particular implementations described in these example embodiments. Therefore, description of these example embodiments is only for purpose of illustration rather than limitation. It should be appreciated that, in the following example embodiments and the attached drawings, elements unrelated to the present invention are omitted from depiction; and dimensional relationships among individual elements in the attached drawings are illustrated only for ease of understanding, but not to limit the actual scale.

Referring to FIG. 1, the arrowhead 100 includes a body 102, a tip 104, battery housing 106 and blades 108. The tip 104 is disposed on a first end of the body 102 and the battery housing 106 is disposed on a second end of the body 102 opposite the first end. The blades 108 extend radially outwards form the body 102 and extend between the first and second ends. The radial height of the blades is greater at the second end of the body than at the first end of the body.

Referring to FIGS. 2-5, the arrowhead of FIG. 1 is shown without the body so that internal structures may be seen. Disposed within a hollow portion of the body 102, starting adjacent the first end and going rearwards, are a collimating lens 110, a front laser diode 112, a circuit board 114, a retention screw 116, a spring contact 118, and a battery 120.

The collimating lens 110 focuses and concentrates the light beam provided by laser diode 112 so that it projects from the center axis of the arrowhead. The lens 110 also seals out water and debris from entering the body of the arrowhead. The lens 110 is disposed adjacent the first end of the body 102 and adjacent to, or partially within, the tip 104.

Figure 3:
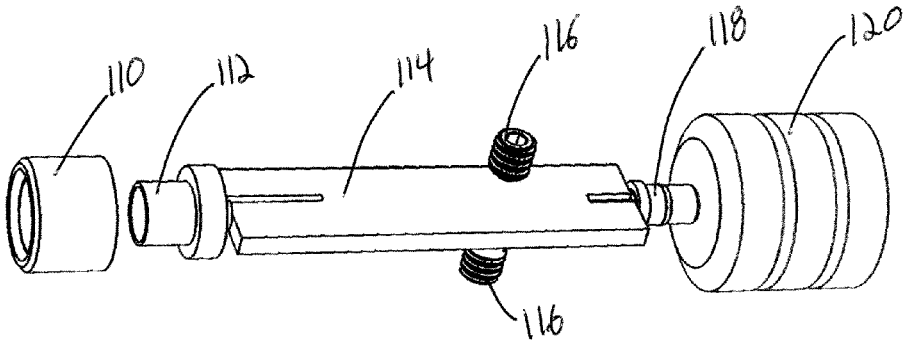
FIG. 3 is a perspective view of certain components of an arrowhead according to an example embodiment of the present invention.
Figure 4:
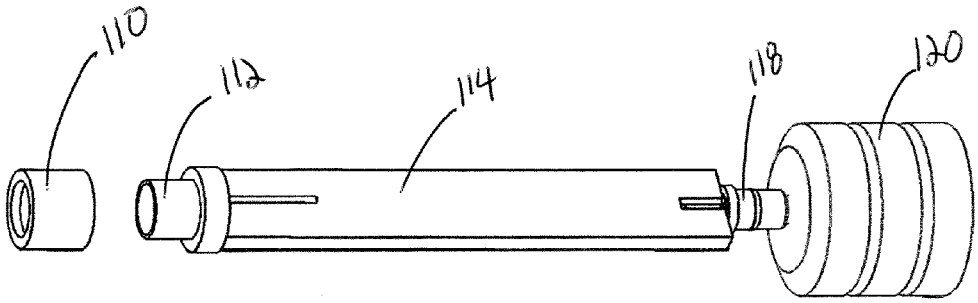
FIG. 4 is a perspective view of certain components of an arrowhead according to an example embodiment of the present invention.
Figure 5:
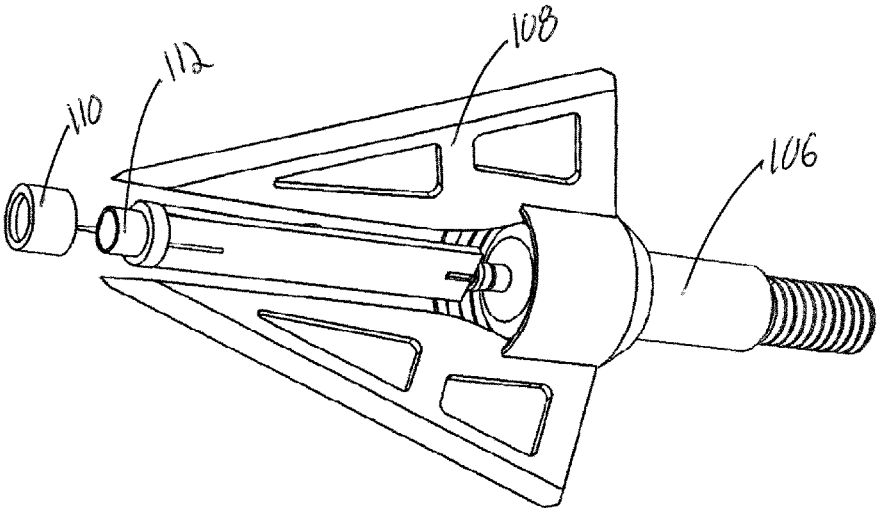
FIG. 5 is a cutaway perspective view of an arrowhead according to an example embodiment of the present invention.
Figure 6:
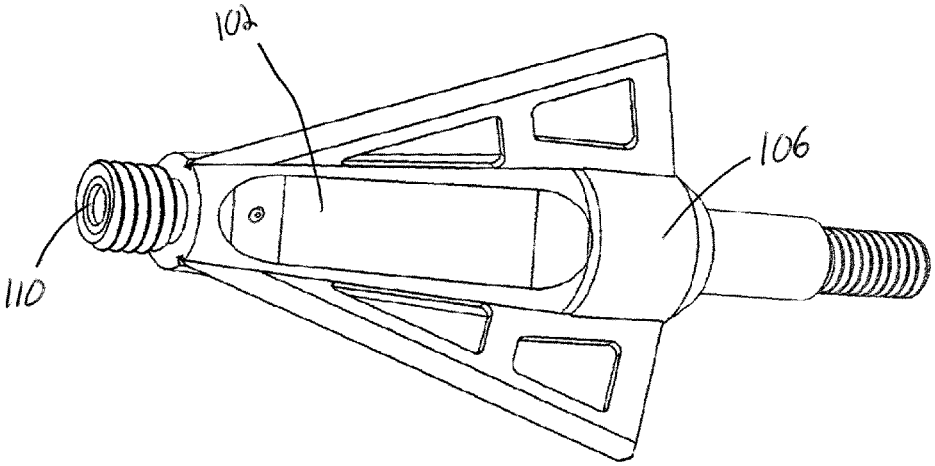
FIG. 6 is a perspective view of a portion of an arrowhead according to an example embodiment of the present invention.

The lens 110 in FIGS. 4-6 has a smaller diameter than the lens 110 of FIG. 3. By making the lens smaller, the lens can be fitted generally flush with the outer most or forward most surface of the body 102 as shown in FIG. 6. This arrangement minimizes the amount of debris that can accumulate inside the opening of the tip 104 and allows for an easy way to clean out the debris from the tip 104 and potentially polish the collimating lens 110 if it becomes scratched with repeated use.

The front laser diode 112 provides a laser beam that projects through the lens 110 and creates a single spot on the selected target. Persons skilled in the art will recognize that a variety of suitable laser diodes may be used, including, for example a 532 nm (green laser diode) 635 nm or 650 nm (red laser diode) or other visible light wavelengths. The front laser diode 112 is disposed adjacent to the lens 110 and faces the first end of the body 102 so that the laser beam projects forward from the tip 104.

The circuit board 114 is disposed between the front laser diode 112 and the spring contact 118. The circuit board 114 includes a hall effect sensor, an accelerometer and a microprocessor. The hall effect sensor responds to a change in magnetic field, so that it can function as an on/off switch when a magnet is placed on the user's bow. For example, the magnet can be placed on the shelf of the bow near the arrow rest. Then the hall effect sensor will cause the forward laser to turn on when the archer is at full draw. The hall effect sensor will also act as a draw length check because the laser will only activate when the bow is pulled back to a specific spot. The use of a hall effect sensor in this application will eliminate the need for a kisser button to verify that the arrow has been pulled back to the proper location prior to the shot. Once the arrow is released, the hall effect sensor will sense that the magnet is no longer present, and will then turn off the front laser diode 112, thereby saving battery power.

The accelerometer included in the circuit board 114 is responsive to acceleration forces. One suitable accelerometer is a 3-axis accelerometer, model CMA 3000 from VTI Technologies or the model ADXL-345 from Analog Devices. However, other types of accelerometers may be used without departing from the scope of the invention. Using information from the accelerometer, a rear laser or light emitting diode ("led") 122 (indicated in FIG. 9) can be turned on when a certain preset value is reached, for example the arrow reaching a speed of 150 feet per second. The laser or led output can be pulsed as well, for example, every 2 seconds. The rear laser or led 122 faces the rear of the arrow and illuminates a transparent nock as will be explained later in this specification. The lit or flashing nock enables a user to more easily find the arrow, including wounded game shot with the arrow. The rear facing laser or led 122 can also be controllably pulsed by the microprocessor such as model CY8C21123 from Cypress Semiconductor to transmit data to a receiver device, such as a laptop computer, IPHONE application, customized receiver unit or portable reception and processing device. The accelerometer further includes a tap sensing feature. Such feature allows the user to tap the arrow to turn the rear led or laser on/off or to transmit data, depending on the set number of taps corresponding to the desired function.

The microprocessor on the circuit board includes memory and programming to carry out the various functions described in this specification. Various flight data can be recorded in the memory, including flight time, acceleration, velocity and flight distance. This data can be useful to assist a user in fine-tuning or aligning a sighting/aiming system.

The alignment screws 116 are used to secure the circuit board. The positive terminal of the batteries contacts the battery housing 106 and then the arrowhead body 102. This configuration permits the screws 116 to transfer battery power from the arrowhead body 102 to the circuit board 114. The screws 116 will also ensure that the Hall Effect sensor on the circuit board 114 will remain in a given position to the outer body of the arrowhead to allow the hall effect sensor to properly detect the small magnetic field created by the magnet that is placed on the shelf of the bow on or near the arrow rest. The screws 116 further permit the user to align the arrow head 100 with the magnet on the bow.

A spring contact 118 is disposed between the circuit board 114 and the battery 120. The spring contact 118 makes contact with the negative side of the battery 120 and completes the circuit between the battery 120 and the circuit board 114. The compression resistance of the spring 118 also aids in keeping the battery 120 and circuit board 114 restrained.

The battery 120 is disposed within the battery cavity 122 portion of the battery housing 106. One suitable battery is an encasement of three 1.2V rechargeable Ni-MH button-cell batteries, totaling 3.6V, available from VARTA. However other suitable battery configurations may be selected by one of skill in the art without departing from the scope of the invention. The battery may comprise either a single battery unit, or a multi-unit configuration.

Figure 9:
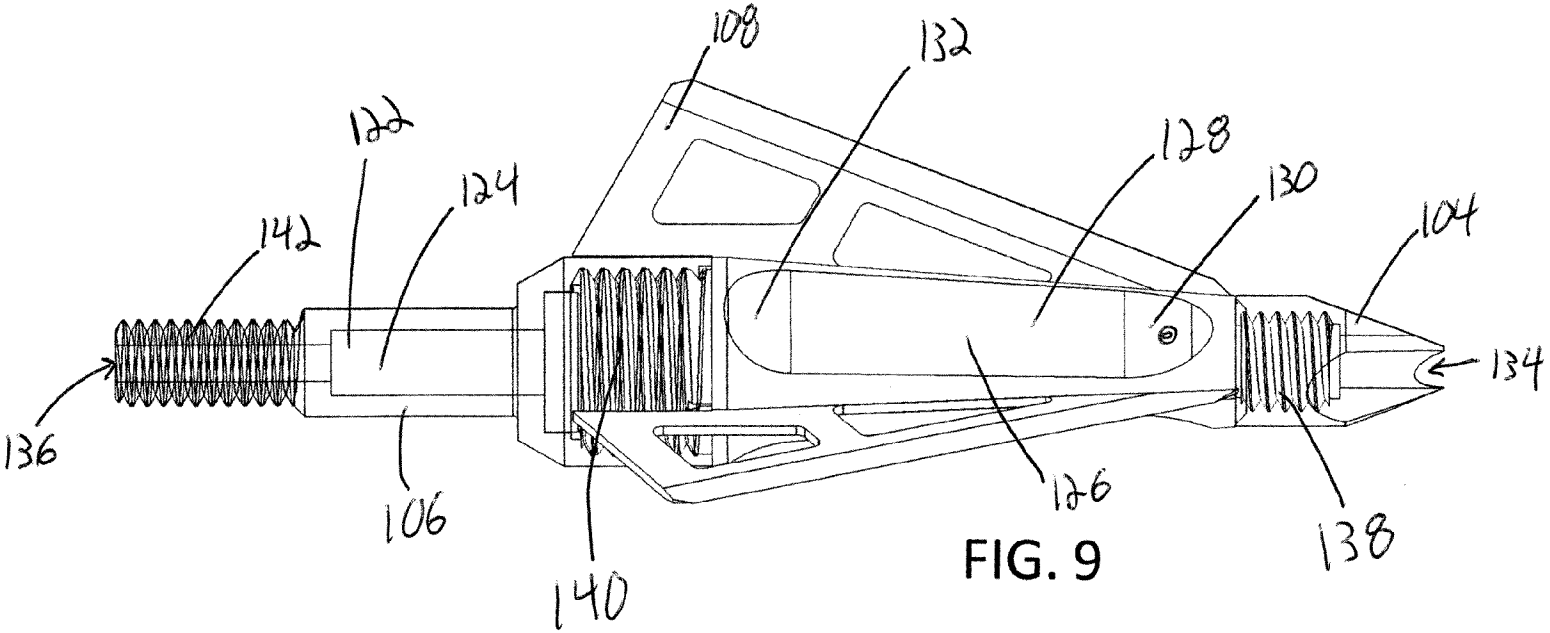
FIG. 9 is a side view of an arrowhead showing hidden detail according to an example embodiment of the present invention.
Figure 14:
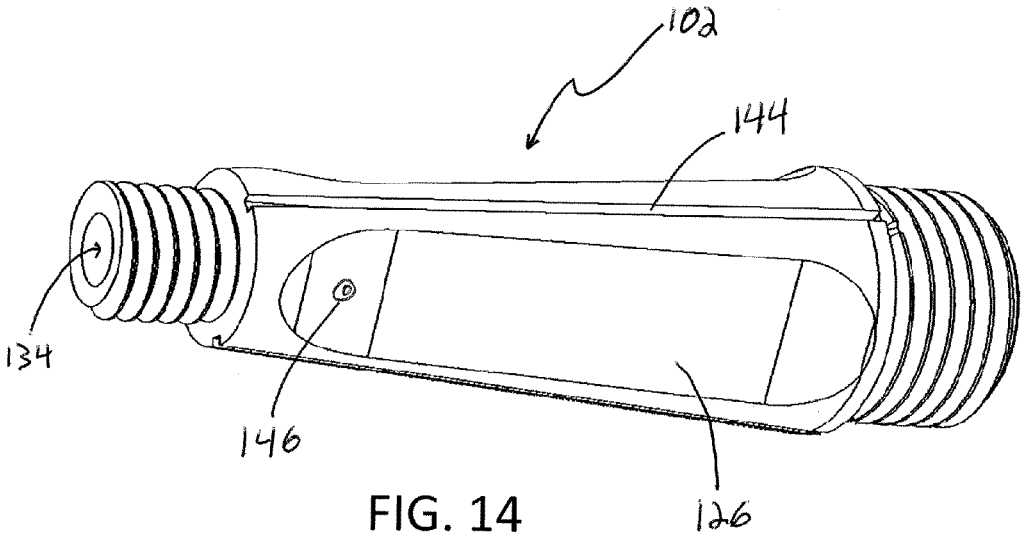
FIG. 14 is a perspective view of an arrowhead body according to an example embodiment of the present invention.
Figure 10:
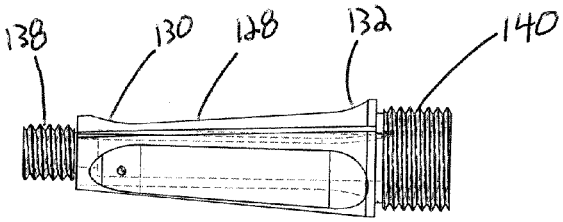
FIG. 10 is a side view of an arrowhead body according to an example embodiment of the present invention.
Figure 12:
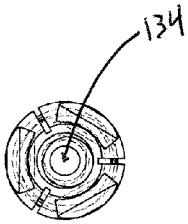
FIG. 12 is a front view of an arrowhead body according to an example embodiment of the present invention.
Figure 11:
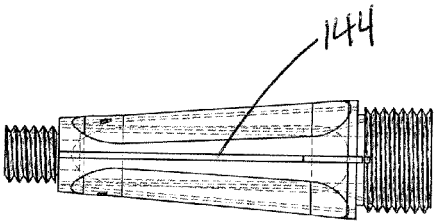
FIG. 11 is another side view of an arrowhead body according to an example embodiment of the present invention.
Figure 13:
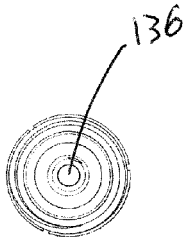
FIG. 13 is a rear view of an arrowhead body according to an example embodiment of the present invention.
Figure 16:
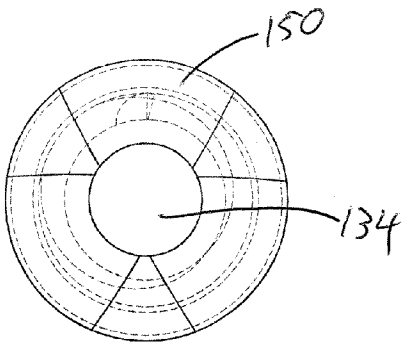
FIG. 16 is a front view of an arrowhead tip according to an example embodiment of the present invention.
Figure 18:
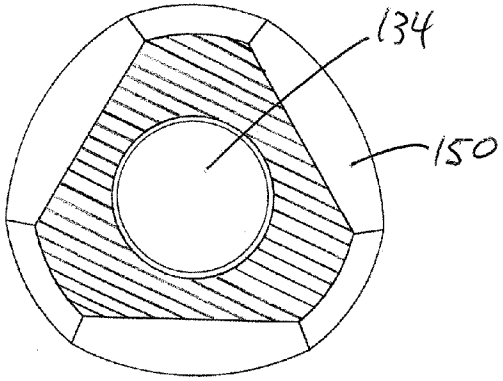
FIG. 18 is a front cross-sectional view of an arrowhead tip according to an example embodiment of the present invention.
Figure 15:
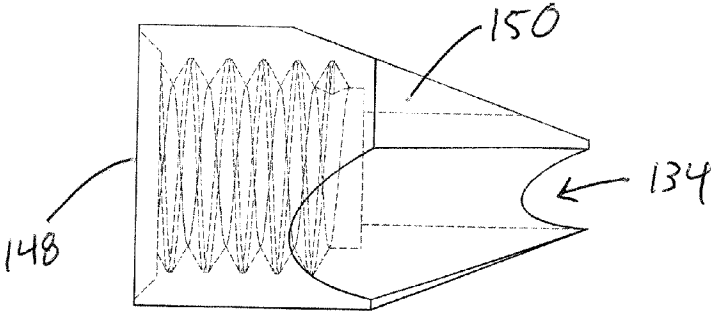
FIG. 15 is a side view of an arrowhead tip according to an example embodiment of the present invention.
Figure 17:
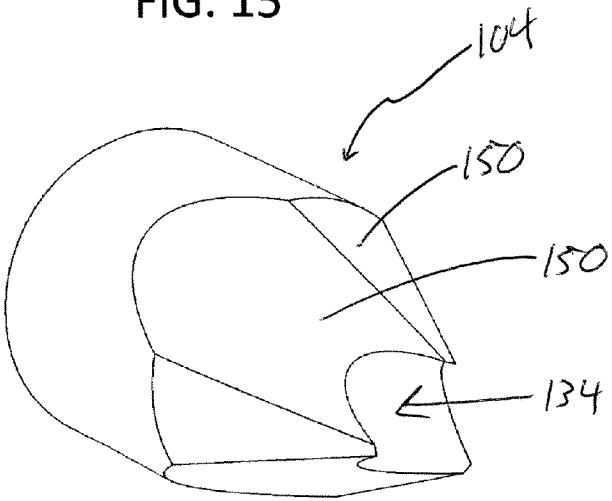
FIG. 17 is a perspective view of an arrowhead tip according to an example embodiment of the present invention.
Figure 19:
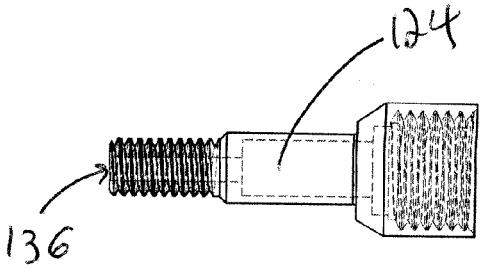
FIG. 19 is a side view of an arrowhead battery housing according to an example embodiment of the present invention.

As can be seen in FIGS. 9 and 19, the battery housing 106 further includes a rear laser cavity 124. The rear laser cavity 124 is configured to receive a rear laser diode module or led assembly 122. One suitable rear laser component is a 650 nm, 3.3 mm, CAN-style laser diode. However, other light sources, such as light emitting diodes and other types of laser diodes may be used without departing from the scope of the invention. The rear laser diode 122 or light source is activated by the microprocessor when the accelerometer indicates that it has reached a set velocity.

As described previously, the rear laser or led 122 will shine through the hollow shaft of the arrow and illuminate the transparent nock. Illuminating the nock using this method and configuration does not add additional weight to the rear of the arrow, which is an advantage over conventional lighted nocks. Illuminating the nock using a collimated laser diode allows the nock to become much brighter than conventional lighted nocks, which is an advantage over conventional devices.

In one particular variation, the circuit board 114, front laser diode 112 and spring contact 118 may be encased in a molding to protect the components from high g-forces. The molding can be a plastic material molded over the above-mentioned components.

Figure 7:
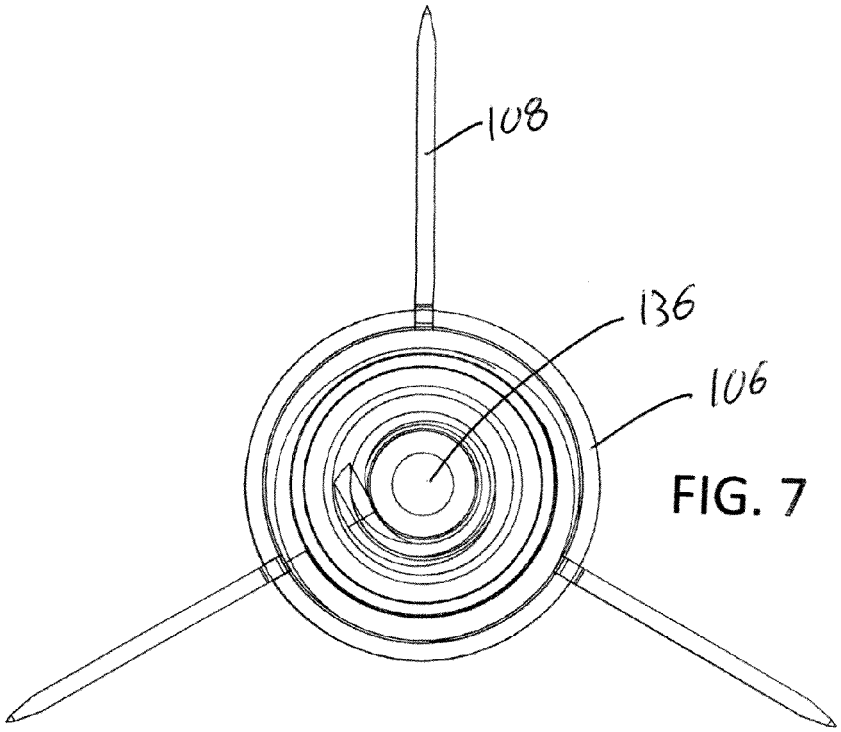
FIG. 7 is a rear view of an arrowhead showing hidden detail according to an example embodiment of the present invention.
Figure 8:
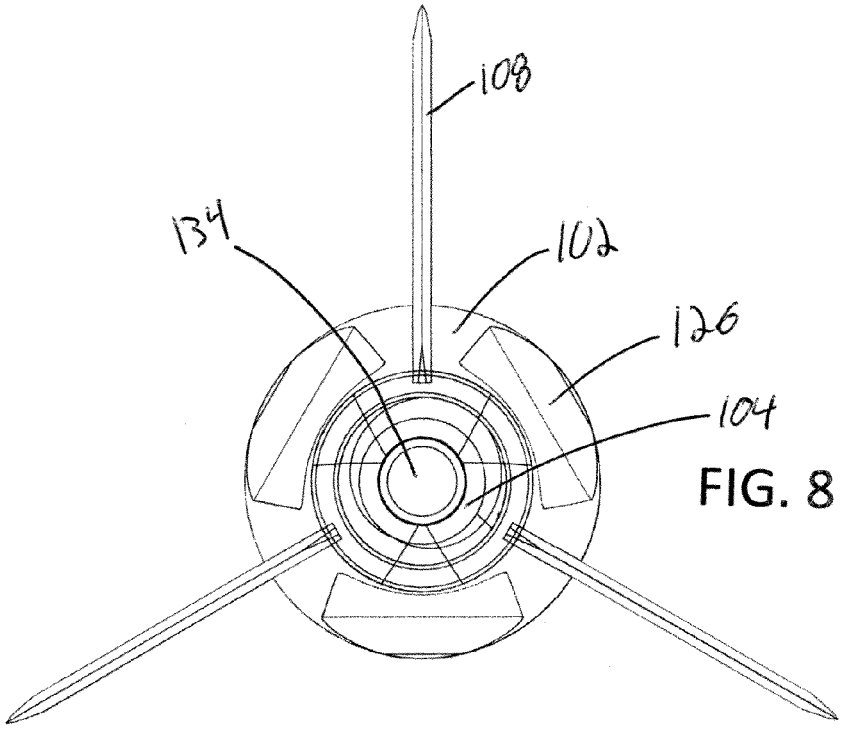
FIG. 8 is a front view of an arrowhead showing hidden detail according to an example embodiment of the present invention.

Referring to FIGS. 7-9, the arrowhead 100 is shown with various hidden detail in order to better understand this disclosure. The body 102 includes a plurality of facets 126 arrayed around its longitudinal outer surface. These facets 126 comprise a generally planar portion 128 spanning between two beveled portions 130 and 132. Front beveled portion 130 is located adjacent the front of the arrowhead. Rear beveled portion 132 is located rearward of the front beveled portion 130. The preceding configuration reduces the amount of friction that is caused on the body 102 while penetrating a target and reduces the total weight of the arrowhead.

A front aperture 134 in the tip 104 of the arrowhead extends from the front of the laser diode 112 through the tip 104. This front aperture 134 permits the collimated laser light to emit from the arrowhead in a forward direction.

A rear aperture 136 in the battery housing extends from the rear laser through the end of the battery housing. This rear aperture 136 in the battery housing 106 permits the light from rear laser or led 122 to travel through the hollow shaft of the arrow to illuminate the nock.

FIG. 9 also shows the assembly of the body 102, tip 104 and battery housing 106. The body 102 has a front male threaded portion 138 for securing with a corresponding female threaded portion of the tip 104. The body 102 also has a rear male threaded portion 140 for securing with a corresponding female threaded portion of the battery housing 106. The battery housing 106 has a male threaded portion 142 for securing with a corresponding female threaded portion of the arrow shaft.

Referring to FIGS. 10-14, the arrowhead body 102 is shown. The body 102 comprises an aluminum material, although other materials, for example plastics and metals, can be used without departing from the scope of the invention. The internal diameter of the front male threaded portion 138 defines the front aperture 134 or opening through which the forward laser light emanates. The internal diameter of the rear male threaded portion 142 of the battery housing 106 defines the rear aperture 136 or opening through which the rearward light emanates.

A slot, channel or groove 144 is defined in the outer longitudinal surface of the body 102 and spans between the front threaded portion 138 and rear threaded portion 140. Groove 144 is configured and sized to receive a blunt side edge of the blades. The grooves are disposed radially in between the facets 126.

Three set screws 146 are provided in their respective apertures in the front beveled portions 130 to permit adjustment of the aim of the front laser diode 112. Thus, the laser beam direction can be adjusted to ensure that it is co-axial with the center axis of the arrow shaft.

Referring to FIGS. 15-18, the tip 104 of the arrowhead is shown. The internal diameter of the tip defines the front aperture 134 or opening through which the forward laser light emanates. The rear of the tip includes a recessed or female threaded portion 148 for rotational securement of the front portion of the blades 108 and with the respective front male threaded portion 138 of the body.

The tip 104 further includes a plurality of facets or beveled portions 150 that start at the outer diameter of the converge as they approach the forward-most portion of the tip 104. The facets 150 terminate at the intersection with the front aperture 134 in three peaks or points and define a sharpened hollow tip. The hollow tip configuration is advantageous because the entire cutting diameter is sharpened, unlike tips that form a single point.

The hollow tip configuration punches a hole in the target surface, instead of the conventional 3 cut lines created by a single tip configuration. In addition, blood in target prey is less able to coagulate due to the wound shape compared to a conventional configuration. As a result, a faster bleedout is achieved from both entry and exit wounds of the prey. A faster bleedout creates an improved blood trail and a faster kill. A faster kill is more humane and makes the wounded prey easier to track. The tip 104 comprises a stainless steel material, although other materials, for example plastics and metals, can be used without departing from the scope of the invention.

Figure 20:
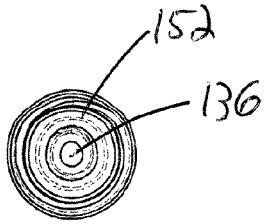
FIG. 20 is a front view of an arrowhead battery housing according to an example embodiment of the present invention.
Figure 21:
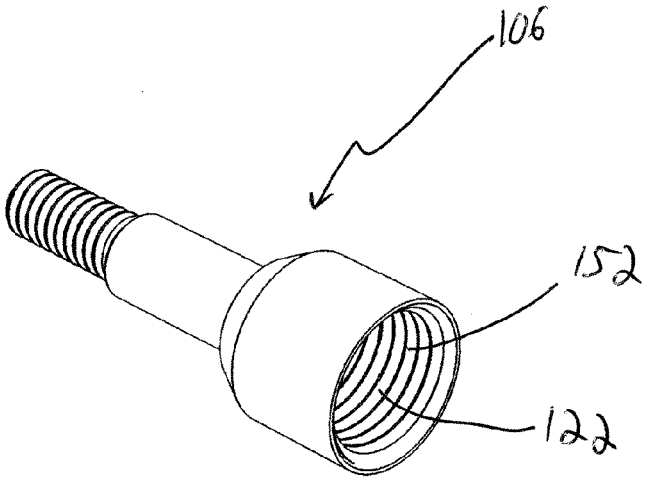
FIG. 21 is a perspective view of an arrowhead battery housing according to an example embodiment of the present invention.

Referring to FIGS. 19-21, the battery housing 106 of the arrowhead is shown. The rear-facing minor internal diameter of the housing 106 defines the rear aperture 136 or opening through which the rear laser or light emanates. The forward facing portion of the housing 106 includes a recessed or female threaded portion 152 for rotational securement with the respective rear male threaded portion 140 of the body 102. The housing 106 comprises an aluminum material, although other materials, for example plastics and metals, can be used without departing from the scope of the invention.

Figure 23:
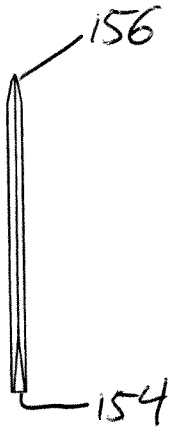
FIG. 23 is a front view of an arrowhead blade according to an example embodiment of the present invention.
Figure 22:
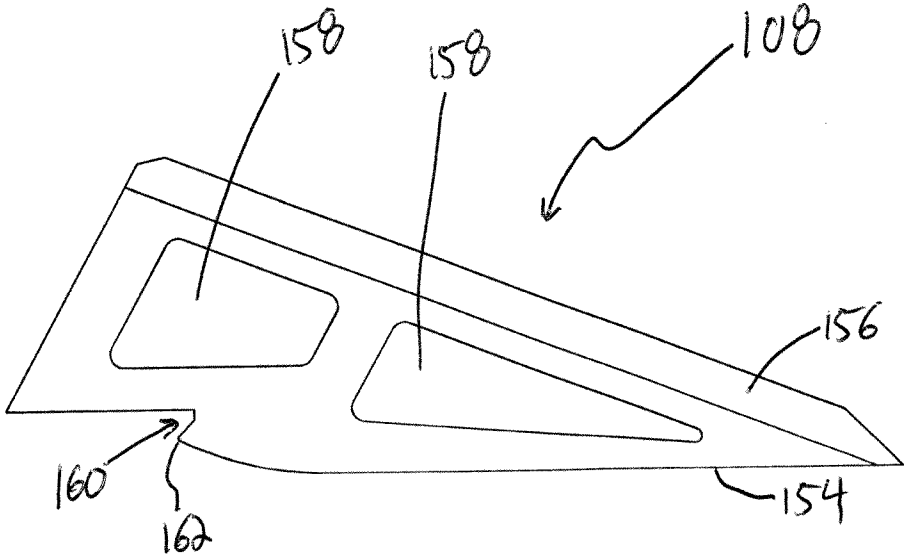
FIG. 22 is a side view of an arrowhead blade according to an example embodiment of the present invention.
Figure 24:
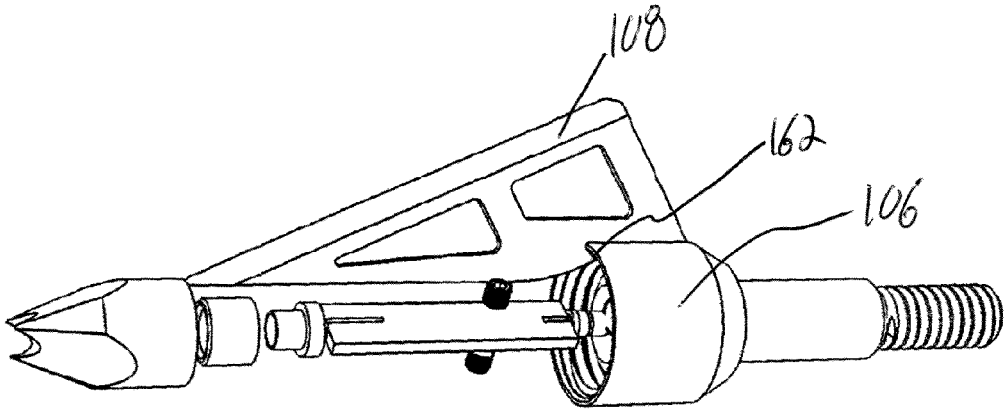
FIG. 24 is a cutaway perspective view of an arrowhead according to an example embodiment of the present invention.
Figure 25:
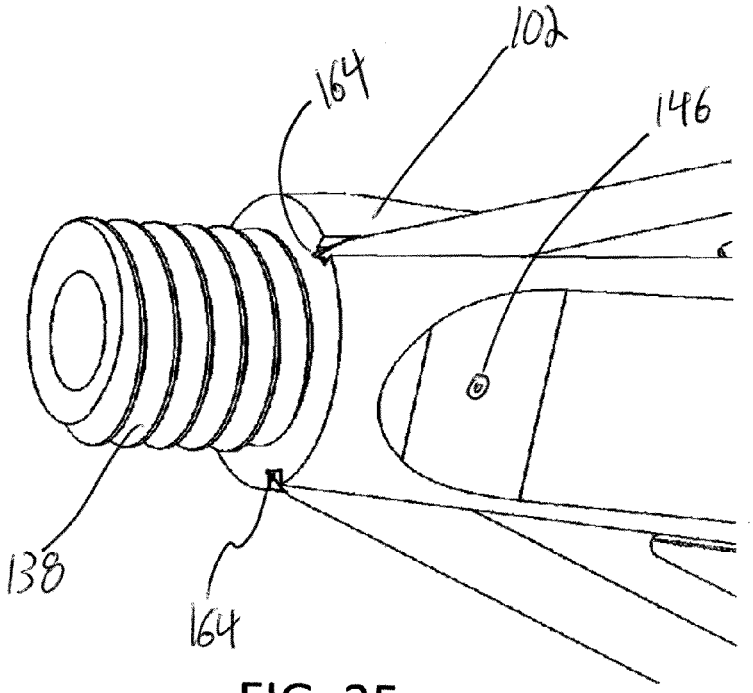
FIG. 25 is a perspective view of a portion of an arrowhead according to an example embodiment of the present invention.
Figure 26:
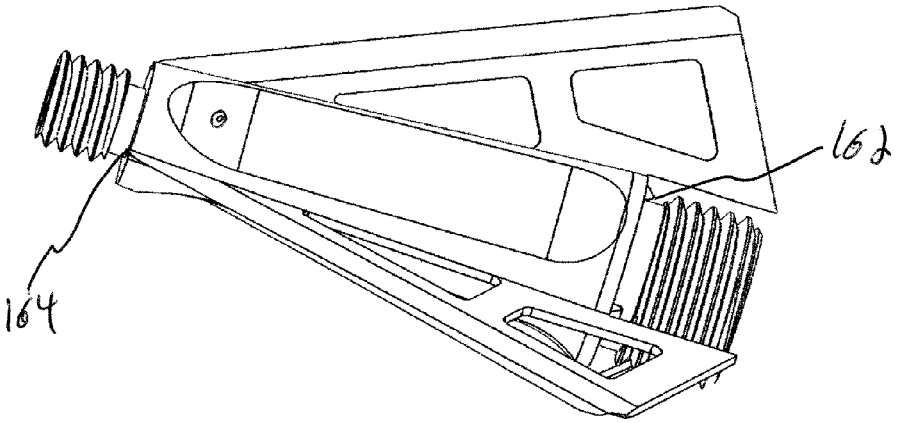
FIG. 26 is a perspective view of a portion of an arrowhead according to an example embodiment of the present invention.
Figure 27:
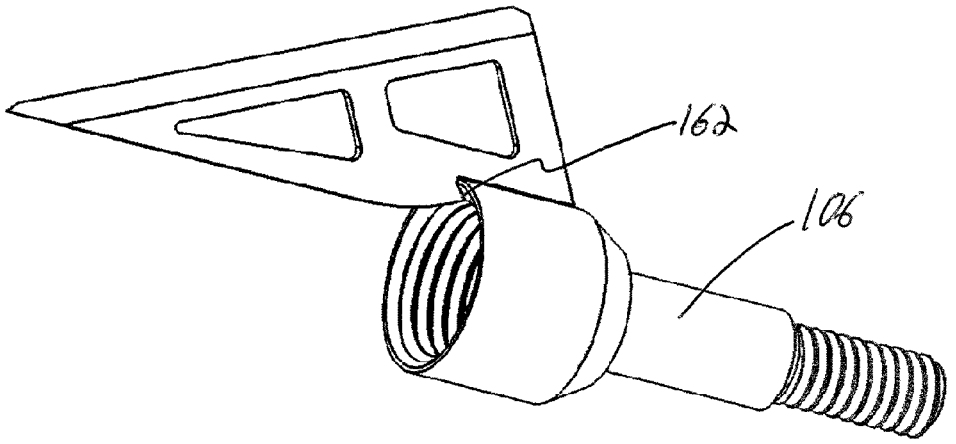
FIG. 27 is a perspective view of a portion of an arrowhead according to an example embodiment of the present invention.
Figure 28:
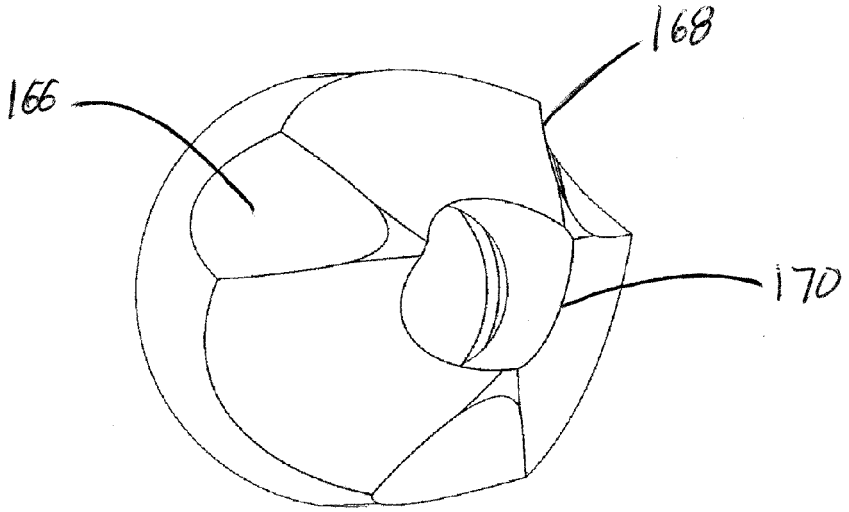
FIG. 28 is a perspective view of an arrowhead tip according to an example embodiment of the present invention.
Figure 29:
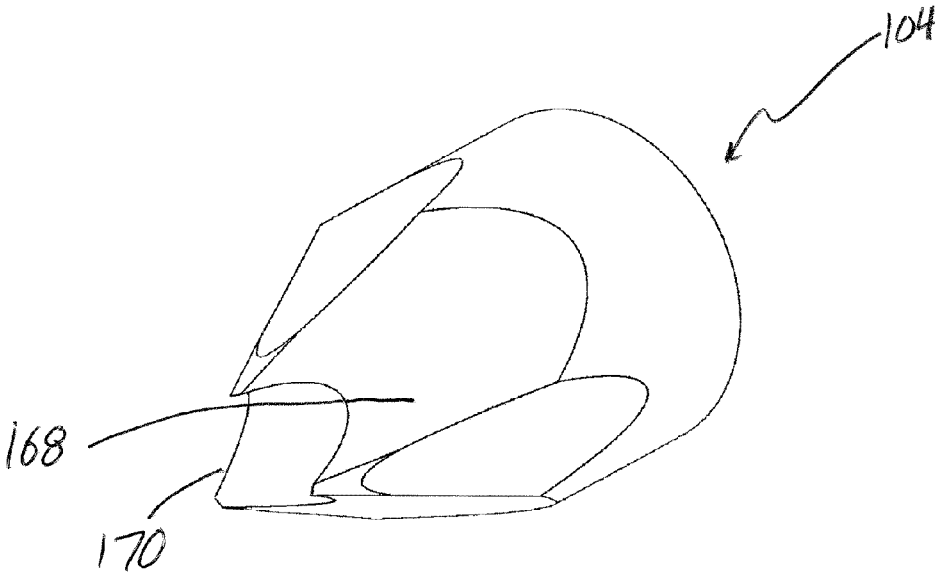
FIG. 29 is a perspective view of an arrowhead tip according to an example embodiment of the present invention.
Figure 30:
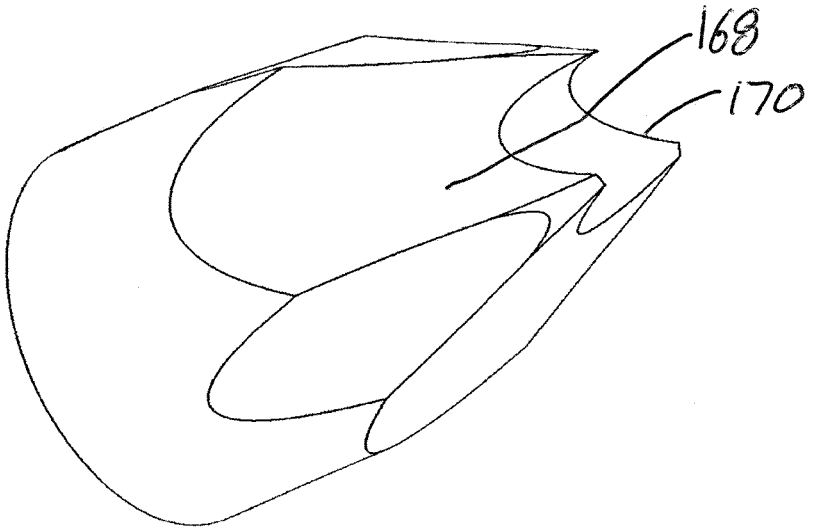
FIG. 30 is a perspective view of an arrowhead tip according to an example embodiment of the present invention.
Figure 31:
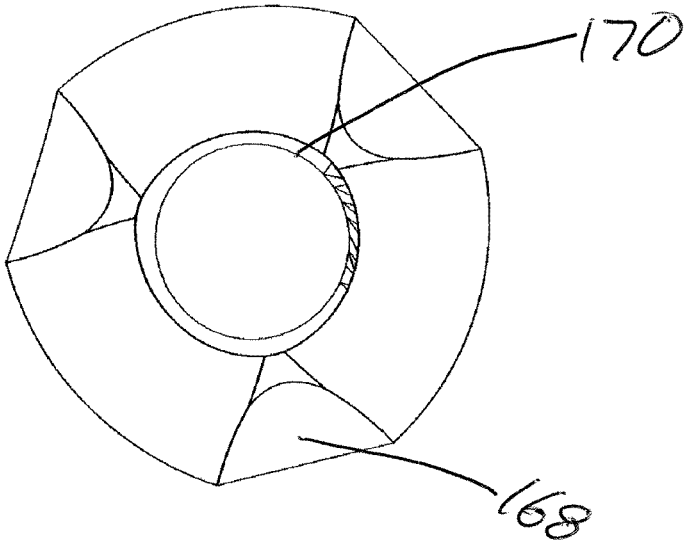
FIG. 31 is a front view of an arrowhead tip according to an example embodiment of the present invention.
Figure 32:
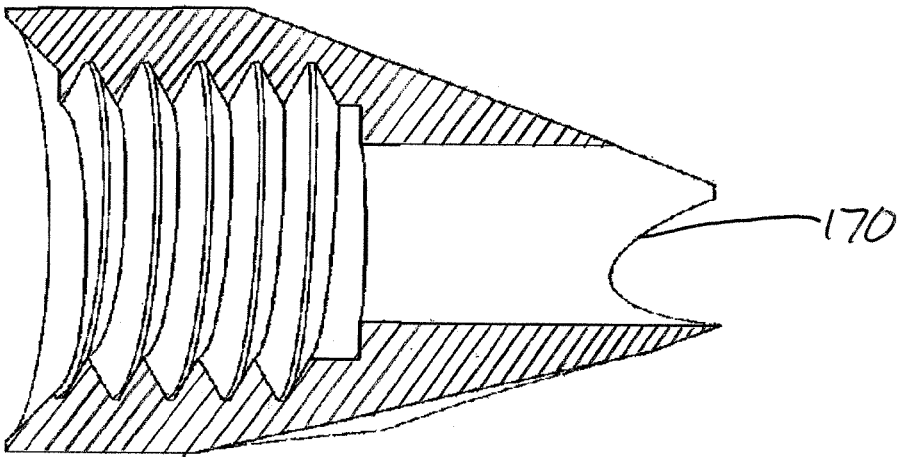
FIG. 32 is a side sectional view of an arrowhead tip according to an example embodiment of the present invention.
Figure 33:
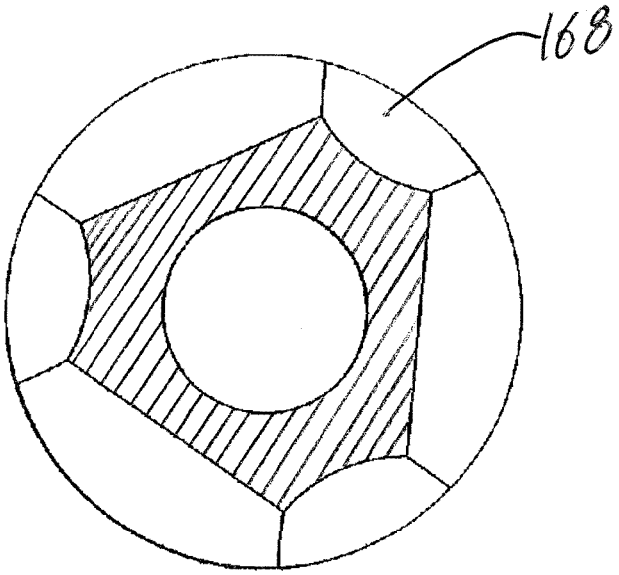
FIG. 33 is a front sectional view of an arrowhead tip according to an example embodiment of the present invention.

Referring to FIGS. 22-23, a blade 108 of the arrowhead is shown. The blade 108 comprises a stainless steel material, although other materials, for example plastics and metals, can be used without departing from the scope of the invention. The blade 108 is generally triangular shaped in side profile. The blade 108 includes a blunt side or edge 154 configured to be received in the groove 144 of the body 102. Opposing the blunt side at an oblique angle is a sharpened side or edge 156. The sharpened side 156 presents a sharp edge for cutting the flesh of the target. The flat side surfaces spanning between the blunt 154 and sharp edges 156 may be provided with one or more apertures 158 therethrough. The apertures 158 provide for a lighter blade. A securement notch 160 is defined in the blunt edge 154 and is configured to contact an inside diameter of the female portion 152 of the battery housing 106. Such configuration permits the blade 108 to be secured in the groove 144 of the body 102 as will be explained in the following paragraphs. The blades extend rearward past the arrowhead body 102 to provide for more cutting surface without adding significant weight. The arrowhead may be configured to have two, three, four or more than four blades.

Referring to FIGS. 24-27, it can be seen that the notch 160 of the blade 108 abuts against the outer diameter of the female portion of the battery housing 106. The flanged portion 162 of the notch protrudes inside of the periphery of the battery housing 106 so that it cannot be pulled away from the arrowhead body when secured in place. The forward corner of the blade formed by the intersection of the blunt '54 and sharp 156 edges is secured in place by fastening of the tip 104 on the body 102. The forward tip 164 of the blade 108 protrudes forward beyond the groove. The protruding portion 164 is secured in place by the inner diameter of the threaded portion of the tip 104 when tightened in the front male threads 138 of the body 102.

Referring to FIGS. 28-33, another embodiment of the arrowhead tip 104 can be seen. This configuration includes a three-point tip with six-cutting edges. There are six scalloped regions 166 radially spaced, thereby defining six cutting edges 166. The scalloped areas 166 may be of varied size or shape, or all similar. In the configuration shown, the sizes and shapes are varied so as to define three projecting pointed tips arrayed about the circular sharpened cutting surface 170. Increasing the number of cutting surfaces reduces the friction that each surface experiences when impacting the target surface. Thus the target surface penetration is more efficient. This makes it easier for the tip 104 to penetrate the target surface.

Figure 34:
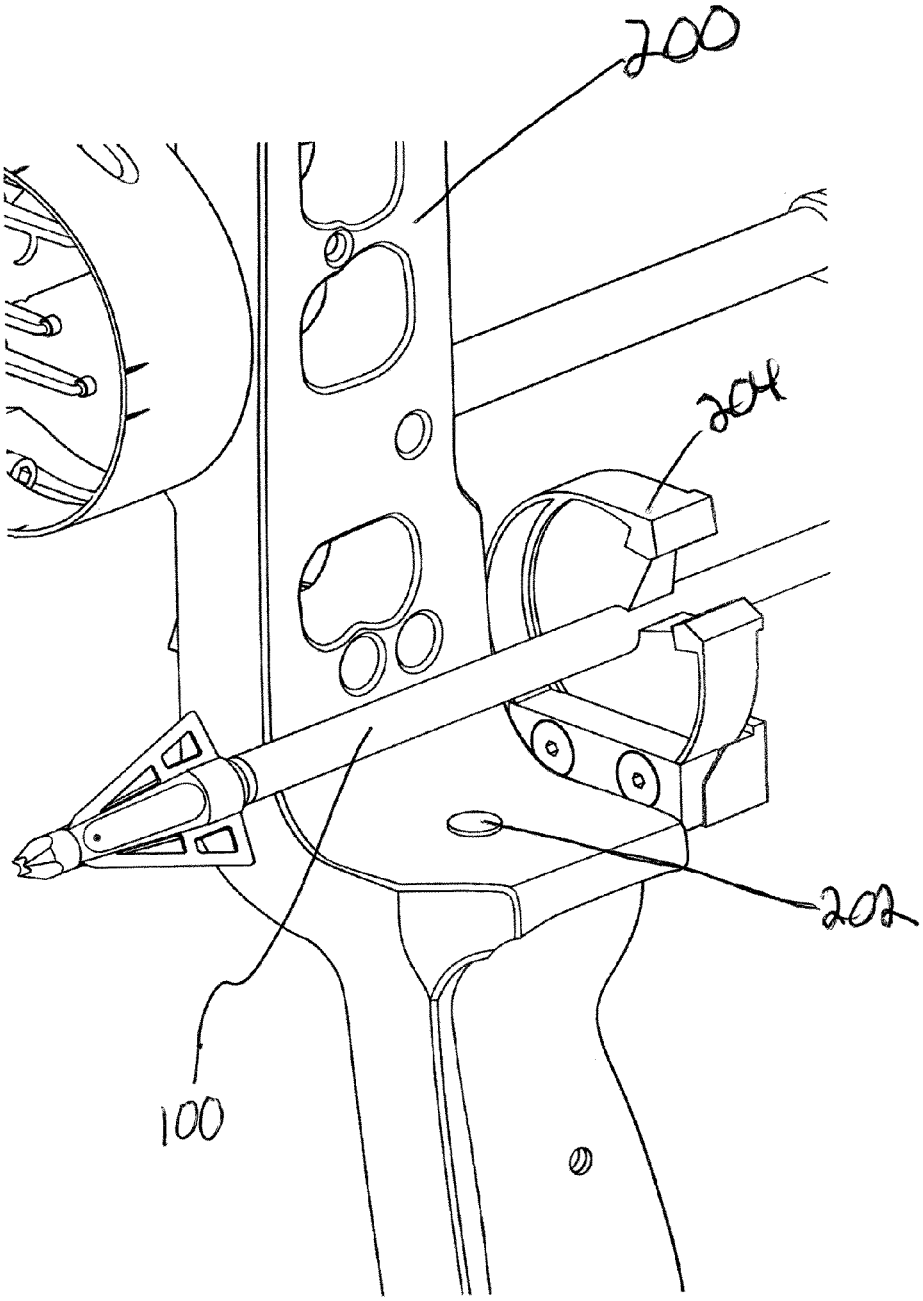
FIG. 34 is a perspective view of a portion of a bow with a portion of an arrow according to an example embodiment of the present invention.
Figure 35:
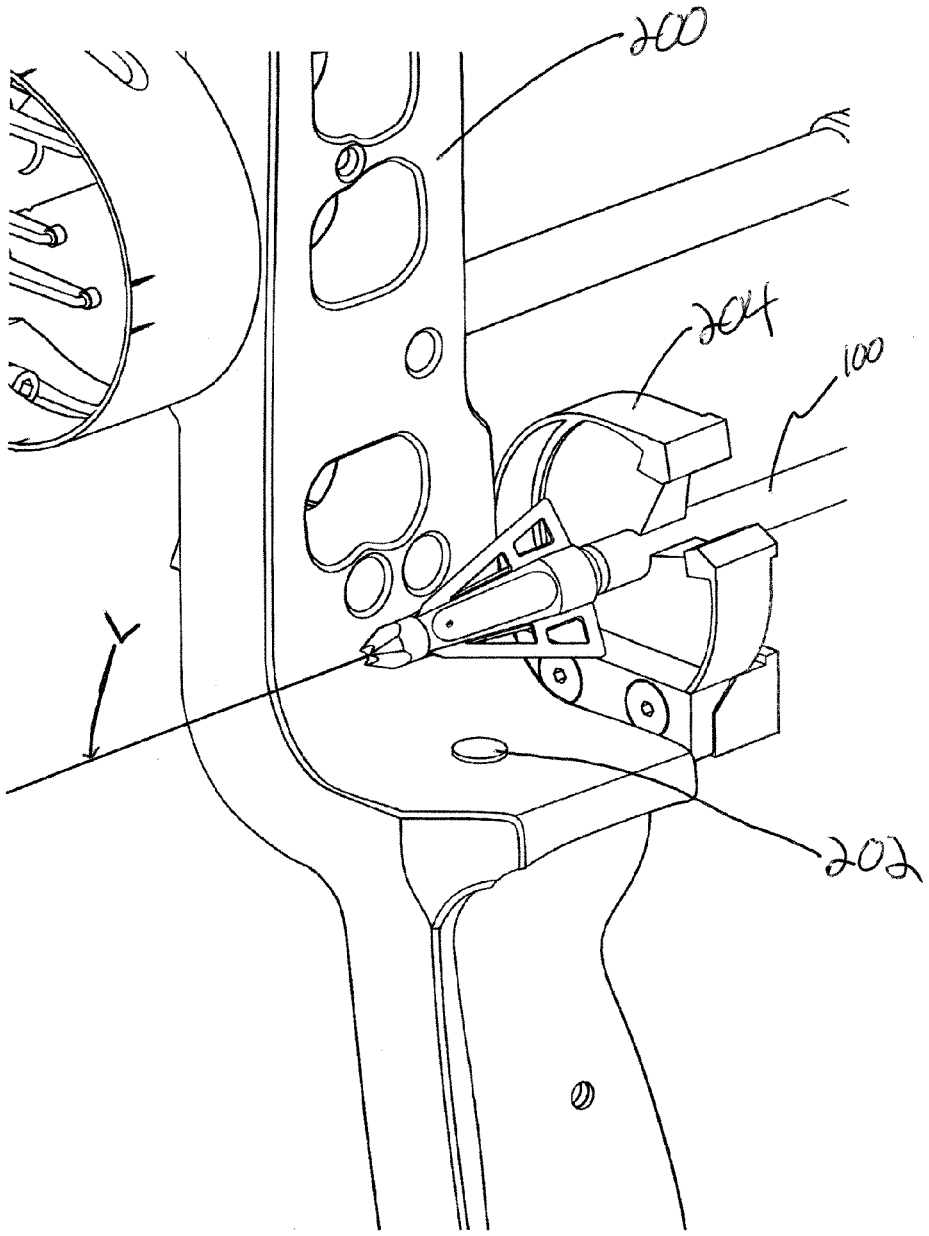
FIG. 35 is a perspective view of a portion of a bow at full draw with a portion of an arrow according to an example embodiment of the present invention.

Referring to FIGS. 34-35, the use of the hall effect sensor to turn the forward laser on is illustrated. It should be understood that the bow and bow rest structure illustrated in the figures is exemplary and that other types and configurations can be used without departing from the scope of the invention. The bow 200 is provided with a magnet 202 near the arrow rest 204 on a horizontal surface. Alternatively, the magnet could be provided to a vertical surface. In a further alternative, multiple magnets can be provided on more than one surface.

In FIG. 34, the arrow is not yet at full draw. The forward laser is not yet turned on. Now referring to FIG. 35, the arrow is shown at full draw on the bow. The proximity to the magnet 202 has triggered the hall effect sensor and the laser is turned on as illustrated by the laser beam L. The beam L will cause a spot to illuminate on the target corresponding to the center axis of the arrow. Thus, the archer or user is able to best aim the bow. Once the hall effect sensor is no longer in proximity to the magnet, it will turn the forward laser off. The above described operation conserves battery power.

The magnet and hall effect sensor combination provides certain additional benefits. For example, the laser turning on indicates to the archer that a correct full draw for their arrow length has been achieved and can be used to establish good shooting habits. When hunting, the archer can purposefully over draw or under draw the bow to prevent the laser from turning on until they are ready to take a shot. This conserves battery power and prevents the laser from being on when stalking game so not to alarm the game until a shot is desired. Also, the magnet or magnets help keep the arrowhead in the correct position when at full draw. This is due to the magnetic force exerted on the ferrite material in the arrowhead blades. This stabilizing feature is particularly desired when the user is located, for example, in a tree stand and must hold the bow at a downward or rotated angle where the bow may not be level with the ground.

Figure 36:
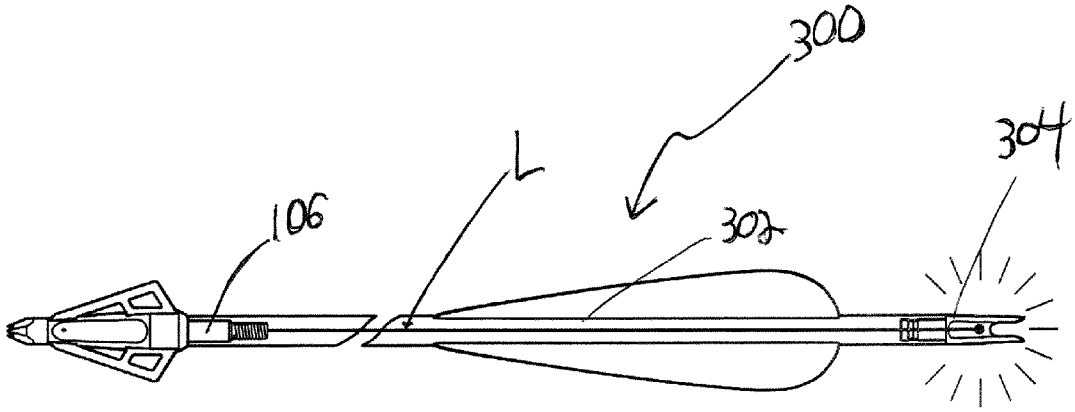
FIG. 36 is a side view of an arrow according to an example embodiment of the present invention showing certain internal detail.

Referring to FIG. 36, an arrow 300, showing internal detail, is depicted in order to illustrate the illuminated nock feature. The laser or led light L emanating from the rear laser or led in the battery housing 106 travels through the hollow arrow shaft 302 until it encounters the nock 304 disposed at the rear of the arrow shaft 302. The clear prismatic nock 304 illuminates due to the internal reflection of the laser or led light. The nock 304 comprises a clear plastic material, but other materials may be used without departing from the scope of the invention. The illuminated nock 304 makes it easier to locate the arrow, and thus any prey in which it is embedded. The nock 304 can be lit constantly, or pulsed to transmit encoded data to a receiver device. This configuration does not require additional electronic components disposed in the rear of the arrow 300, so the balance and overall weight of the arrow does not become undesirable.

Figure 37:
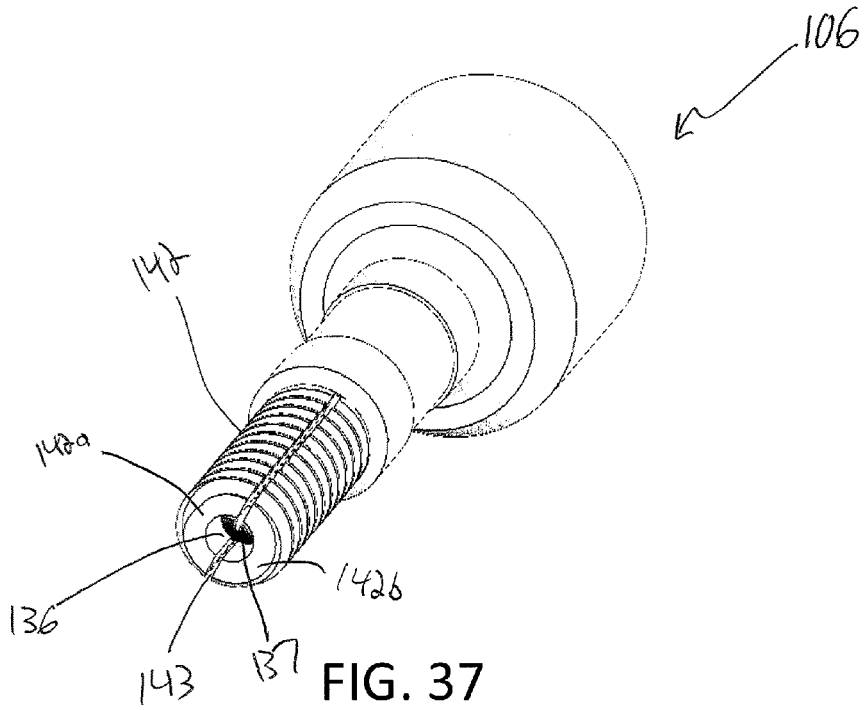
FIG. 37 is a perspective view of an arrowhead battery housing according to an example embodiment of the present invention
Figure 38:
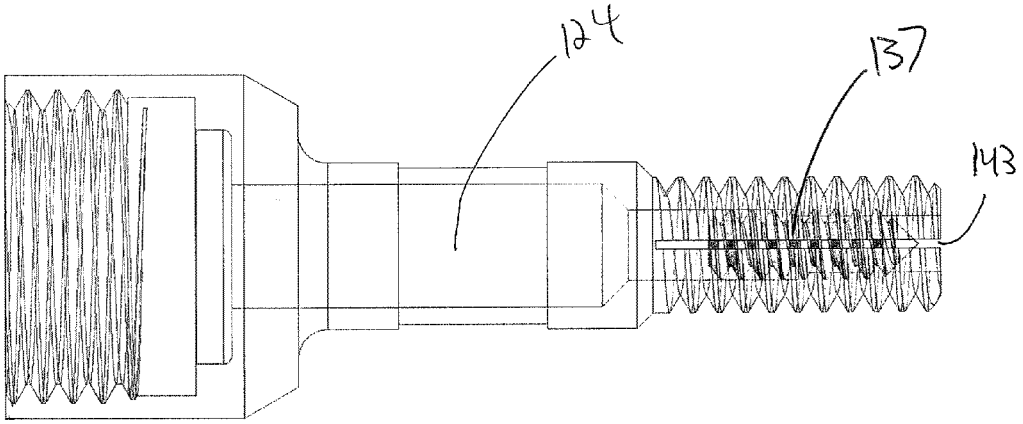
FIG. 38 is a side view of an arrowhead battery housing according to an example embodiment of the present invention
Figure 39:
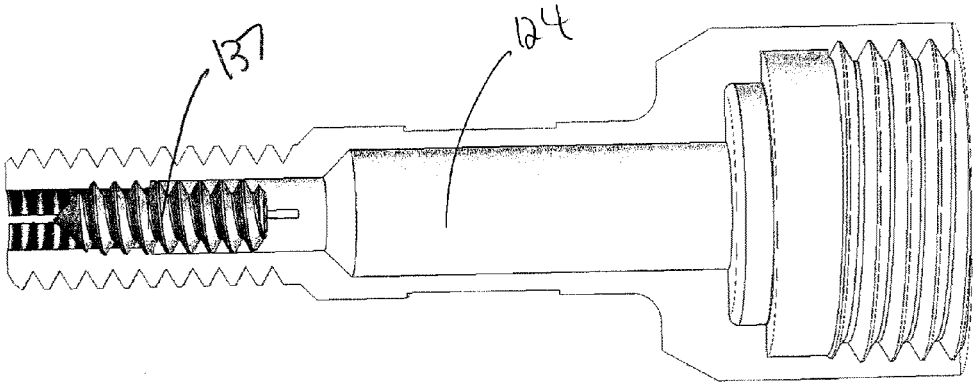
FIG. 39 is a side view of an arrowhead battery housing according to an example embodiment of the present invention.

Referring to FIGS. 37-39, the battery housing 106 is shown according to an additional aspect of certain embodiments of the invention. At least a portion of the male threaded portion 142 of the housing 106 is slotted to form first 142*a* and second 142*b* halves. The slot is designated as inset 143 on the drawings. The inset extends from the outlet of the rear aperture 136 upwards towards the laser cavity 124. A portion or the entirety of the threaded portion 142 may be slotted.

The slot permits each half 142*a* and 142*b* to flex slightly outward from the center bore 136. Thus, the thread halves are configured to expand when a set-screw 137 is inserted into the bore and tightened. The bore can be threaded to facilitate use of the set-screw. As the set screw is tightened down, the side walls of the threaded portion expand laterally outward to lock the broadhead assembly 100 into the arrow shaft.

The set screw locking feature makes the broadhead rotation adjustable or indexable with respect to the rotational orientation of the vanes of the arrow. In contrast, conventional inserts are typically glued into the arrow shaft, so existing broadheads are tightened down until they stop against the front of the insert. This does not allow the end user to align the broadhead to the arrow shaft. The present invention thus allows the end user to make fine adjustments to their broadhead to help tune the arrow and provide for better flight characteristics. For example, aligning the broadhead blades rotationally with the arrow vanes helps with arrow flight and permits the broadhead to remain in the same position (and be repeatedly used in that same orientation) after the laser beam has been aligned so that the arrow can best hit the target at a given distance.

Various embodiments of the present invention can be used in conjunction with the electronic archery sighting system disclosed in co-pending U.S. patent application Ser. No. 12/757,893, entitled, "ELECTRONIC ARCHERY SIGHTING SYSTEM AND BORE SIGHTING ARROW", filed on Apr. 9, 2010, inventor Larry Bay, the disclosure of which is hereby incorporated by reference.

Referring to FIGS. 40-48*c*, various aspects of an electronic archery sighting system will be described. The archery sighting system provides an electronic adjustable sighting device as well as technology that can be included in the arrow to improve shot accuracy and arrow/target recovery.

Figure 40:
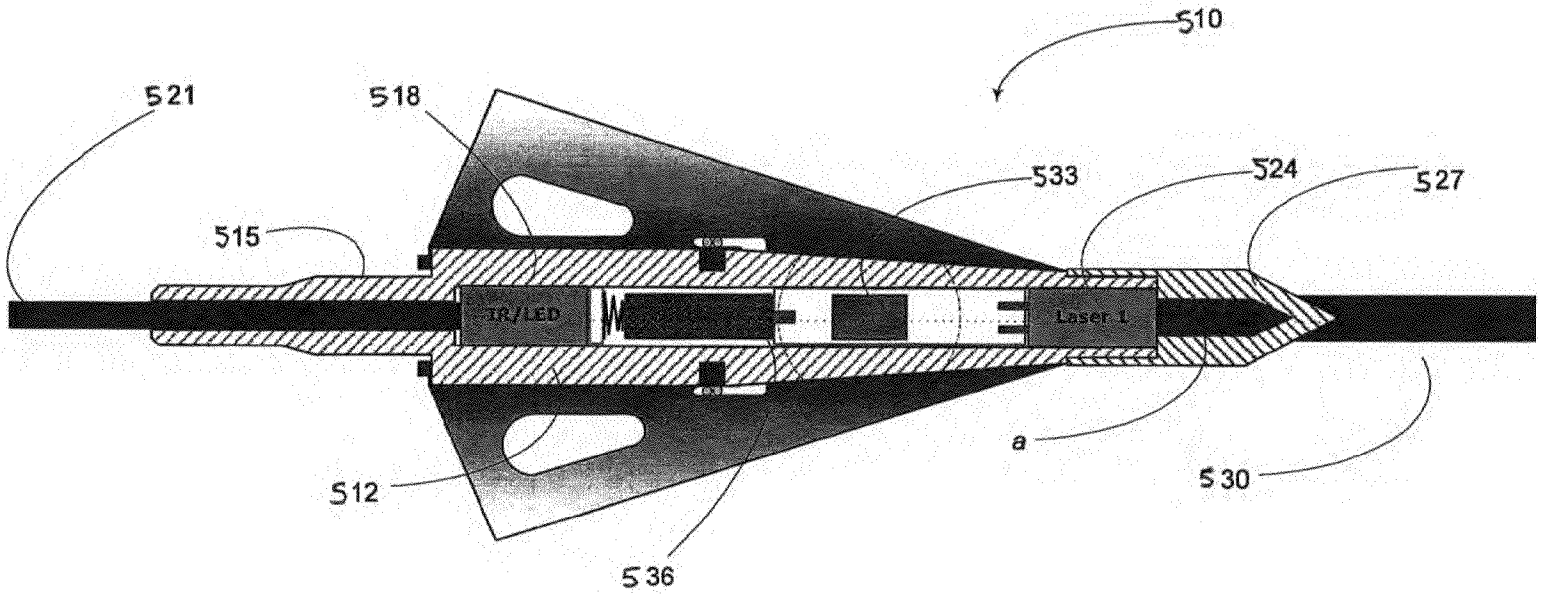
FIG. 40 is a cross-sectional diagram that illustrates an arrow used with the system, in one embodiment.

FIG. 40 is a cross-sectional diagram that illustrates an arrow used with the system, in one nonlimiting embodiment. The bore sighting laser arrow 510 includes, arranged within and on an aft end of a hollow shaft 512, a light transmitting nock assembly 515, an LED/IR transmitter 518 arranged to transmit a beam of IR light 521 through the light transmitting nock assembly 515, and a laser beam 530. The LED/IR transmitter includes both non-coherent and coherent (or laser emitting) diodes and the use of LED is not meant to limit the invention to non-coherent light sources. On a forward end of the shaft 512, a laser 524 is arranged to project a laser beam 530 through a light transmitting head assembly 527 along a principle axis a of the shaft 512, just as the LED/IR transmitter projects the beam of IR light along a in the aft direction. The light transmitting head assembly, in one exemplary embodiment, includes a laser enhancement lens filter (not shown) that enhances the projection of the laser beam 530 downrange along the axis a.

Within the shaft 512 (shown here only as a portion of the arrowhead but extending through the bore sighting laser arrow 510), a processor 533 includes at least one accelerometer (not shown) oriented to measure at least acceleration along the axis a. The inventive arrow includes a power source 536. In one presently preferred embodiment that power source is a battery producing an electrical current by means of chemical reaction such as Nickel metal hydride, Lithium Ion or Alkaline batteries. In another embodiment, a high capacity capacitor will also suitably serve as a power source as the need for large amounts of power is only of very short duration, during the nocking, flight, and immediate aftermath of the flight. One advantage of a capacitor is the very rapid charging that can occur in a charging quiver assembly.

Figures 41A, 41B, 41C, 41D, 46:
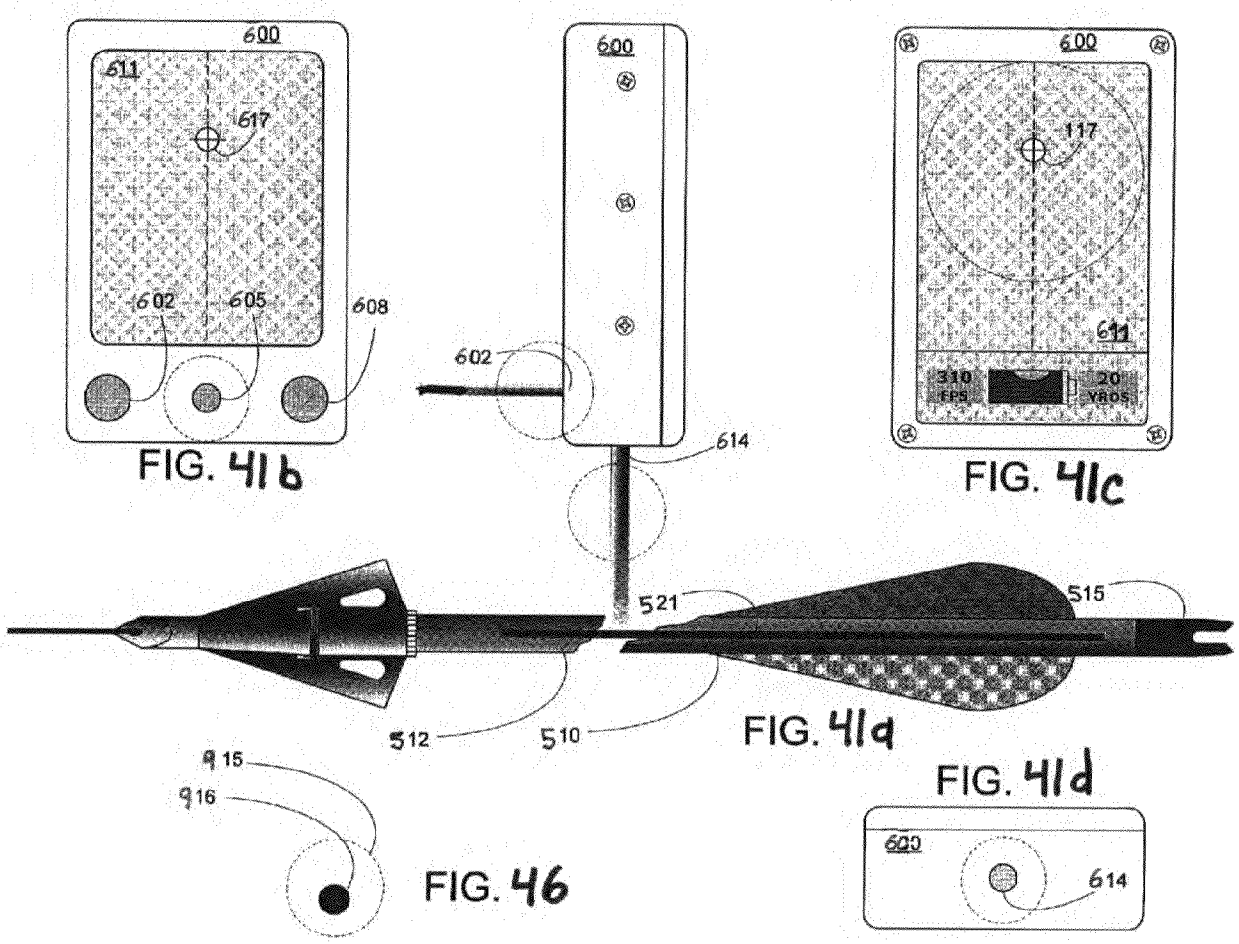
FIG. 41*a* portrays a data flow diagram showing interaction between the arrow and a sighting system.
FIG. 41*b* shows a downrange-side view of an embodiment of the sighting system.
FIG. 41*c* shows an archer-side view of the embodiment of the sighting system.
FIG. 41*d* is a bottom-view of the embodiment of the sighting system.
FIG. 46 is a diagram of an arrow pattern on a target.

Referring to FIGS. 40 and 41*a*, in use, the bore sighting laser arrow 510 interacts with an inventive aiming system 600 (shown in side view) to calibrate the system and for verification of calibration based upon the flight of the arrow. As stated above, the processor 533 includes an accelerometer. Throughout the application, the term processor 533 is not limited to a traditional CPU but encompasses an entire processing unit which might be suitably constructed as a single large-scale integrated circuit or may include a circuit board with a distinct memory chip, at least one accelerometer, busses for data and other known configurations to support the described operations. In one embodiment, the accelerometer includes at least one 3-axis accelerometer, in alternate embodiments, the functions supplied by the at least one 3-axis accelerometer may, instead, be implemented by a single accelerometer in each of three orthogonal axes oriented such that one aligns with the axis a. In a minimal embodiment of the invention, a single axis accelerometer aligned along the axis a will suffice to measure arrow speed along with the other displacement functions of the instant invention, though the single axis accelerometer is not presently preferred.

In one of the 3-axis embodiments, the accelerometer can further enable a "tap technology" to turn the components on or off. By tap technology, the applicant is expressing the means for activation a switch in response to a concussive blow to the bore sighting laser arrow 510 sufficient to impart an acceleration the accelerometer can sense. In response to the blow, the signal generated within the processor can suitably activate or deactivate functions of the bore sighting laser arrow 510. By way of non-limiting example, the laser may be suitably activated prior to or in the course of nocking the arrow by a tap orthogonal to axis a.

Another purpose of the accelerometer is to detect the speed of the arrow (e.g., in feet per second (FPS)). Thus, in a scenario for use, the laser 524 is turned on in response to a suitable tap by the user and then nocked to orient the arrow for flight. Because the laser is used for calibration of the system 600 and only relevant during nocking and the residence of the arrow against the arrow rest prefatory to actual flight, the laser 524 remains on until the processor 533 it turns off when the arrow reaches or exceeds a designatable speed (e.g., 150 FPS). The processor 533 may also, optionally, activate the LED/IR transmitter 18 when the arrow after initial acceleration in flight, slows to a designatable speed (e.g., 150 FPS) and thus projects a signal through the light transmitting nock assembly 515 back to the system 600. In a presently preferred embodiment, the bore sighting laser arrow 510, by means of the LED/IR transmitter 518 will send the accelerometer signal either in a raw or a processed state depending upon the specific embodiment, that data being indicative of the arrow flight acceleration data; the transmission through the light transmitting nock assembly being beamed back to a the system 600 by means of an IR receiver 602 the system 600 comprises.

In still another embodiment of the bore sighting laser arrow 510 interacting with the system, the processor 533 will, after the bore sighting laser arrow 510 has reached a designatable speed (e.g., 150 feet per second) during the speed decay of the bore sighting laser arrow 10 flight, activate the LED/IR transmitter 518, which will transmit the IR beam 521 down through the shaft of the arrow and through the light transmitting nock assembly 515. The IR beam provides a good visual tracking system for arrows during flight and allows for easy recovery of the bore sighting laser arrow 510 after the shot. The bore sighting laser arrow 510 transmitting the IR beam 521 through the light transmitting nock assembly 515 provides a beacon that can be identified with the IR receiver 602. Iterative passes over an area will provide very good directionality of the signal source emanating through the light transmitting nock 515.

The receiver 602 assists the archer in the recovery of the arrow and also receives IR beam 521 that is modulated to transmit data obtained by processor 533 characterizing the bore sighting laser arrow 510 in flight. By at least this means the system is able to obtain flight data which may include acceleration along axis a as well as any components of acceleration that are normal or orthogonal to axis a. The archery sighting system 510 allows an archer to project the laser beam along the axis a to provide a single laser dot on a target. For example, for bows that shoot over 275 FPS, the laser dot may be accurate out to 30-yards.

FIGS. 41*b* and 41*c*, illustrate rear and front view, respectively of the inventive archery sighting system 600 in a presently preferred embodiment shaped and sized to emulate mechanical sights—other embodiments are also possible which will achieve the ends of the instant invention though emulating the current mechanical sights is thought to allow rapid intuitive transfer to use of the instant archery sighting system by archers trained on the mechanical sight. For example, an archer may attach the sighting system 600 to the bow in place of a traditional sighting device. Because it occupies a similar form factor, in the presently preferred embodiment, the archer instinctively handles a bow with the instant system 600 in a manner, when, for example, passing through dense brush so as to preserve the system 600 on its mount in a calibrated position.

Referring to FIGS. 41*a*, 41*b*, 41*c*, and 41*d*, in one preferred embodiment, the sighting system 600 includes a digital camera 605, a laser range finder 608, and a display 611. Optionally the system 600 includes a chronograph magnetic sensor 614, in accord with that granted to Dilber on Feb. 22, 2000 as U.S. Pat. No. 6,029,120 and entitled, "BOW-MOUNTED CHRONOGRAPH" incorporated herein as if fully set out herein by this reference. The chronograph includes the magnetic sensor 614, in one embodiment includes a nonlatching magnetic sensor with a Schmitt trigger output. The magnetic sensor 614 senses the presence of two permanent magnets mounted in fixed distance along axis a which together form a dual, opposite-pole magnetic trigger assembly. The first permanent magnet is oriented such that the north pole is placed outward from the surface of the nonmagnetic arrow shaft 512 and the second permanent magnet is placed with the south pole outward from arrow shaft 512. The required magnetic orientation of permanent magnets is achieved using the electronic sensor 614 provided in chronograph. As the magnets pass under the magnetic sensor 614 in a fixed geometric relation, the temporal interval is directly proportionate to the speed of the bore sighting laser arrow 510 as it leaves the rest. One such chronograph or magnetic sensor might be a Hall Effect sensor.

The chronograph works by timing the interval between a passage of a first chronograph reference on an arrow past the chronograph sensor and a passage of a second chronograph reference on the arrow past the chronograph sensor. As the arrow leaves the bow at speed, the interval is inversely proportionate to bow speed. An optical analogue wherein the references are markings of a color and the sensor is a filtered light and photocell assembly might serve as easily as the described Hall Effect sensor might work in an equivalent analogue to sense the speed of an arrow as it leaves the rest without changing the operation of the invention. Other analogues are readily found in the field of ignition timing for internal combustion engines, the task being largely similar. Data provided the system 600 by the sensor 614 is used either to supplement the data from the accelerometer in the bore sighting laser arrow 510 or in lieu of it such that after calibration, the system 600 will function entirely without the bore sighting laser arrow 10 based upon the speed data received at the sensor 614.

Referring to FIGS. 41*b* and 41*c*, the presently preferred embodiment includes the display 611 that provides an image of a reticule 617 for display of an analogue to the physical pins of metal sights. In the presently preferred embodiment, the display is formed as is taught in accord with that granted to Ryu on Sep. 11, 2007 as U.S. Pat. No. 7,268,488 and entitled, "DISPLAY DEVICE AND MOBILE DISPLAY HAVING A SEMI-TRANSPARENT METAL LAYER" especially as set forth in the transparent embodiment set forth there which is incorporated herein as if fully set out herein by this reference. Transparent OLEDs have only transparent components (substrate, cathode and anode) and, when turned off, are up to 85 percent as transparent as their substrate. When a transparent OLED display 611 is turned on, it allows light to pass in both directions. A transparent OLED display 611 can be either active- or passive-matrix. Because of the transparency of the display 611, it, too, can be readily used by an archer familiar with the mechanical sights as the reticule serves in the instant invention.

Transparent OLED displays have the further advantage that they can be suitably coated to enhance the performance of the nonactivated portions of the transparent OLED display 611. For example, the OLED display may be suitably coated with a filter coating that might, advantageously, shift in neutral density filtering of light in response to ambient light to allow the archer a better view of the target. Other alternate coating might be oleophobic coating, to prevent accumulation of oils and other debris entrapped in oils; nonscratch coating, and even diopter corrective lenses to enhance the downrange view. Additional colored filters might be advantageously used to make the filter more useful in specific environments such as in snowy environments to make the target stand out relative to the background.

The Samsung Mobile Display Corporation exhibited a suitable transparent screen at the 2010 Pepcom's Digital Experience! press event during the Consumer Electronic Show, at the Mirage Hotel on Wednesday on January $6^{th}$. The transparent OLED panel prototype, was designed for use in applications from smartphones, MP3s and very low power usage notebook computers to 'head-up' displays for vehicles, and advertisement displays that are interactive and eye-catching. Not only has Samsung demonstrated that when energized clear transparency when energized and even when unpowered, the prototype has up to a 40% transparency. The transparent OLED represents the highest resolution on the largest screen with high transparency, and is clearly adaptable to the instant invention.

In an alternate embodiment of the display, the sighting system 600 includes the digital camera 605 automatically starts recording when the range finder 608 has "locked" onto the target. In such a manner, the digital camera 605 can be suitably employed to present the same augmented reality experience as the presently preferred embodiment provides to the archer. An augmented reality system incorporates input garnered from a number of sensors to create suitable information cues to be projected upon an image thereby to generate a composite image that bears more information to be positioned in a manner to give geospatial meaning to the presentation of that information. The operation of the elements typically employed in an augmented reality system as well as the calibration required of such a system is described by: Ahlers et al., in "Calibration Requirements and Procedures for a Monitor-based Augmented Reality System", IEEE Transactions on Visualization and Computer Graphics, 1 (3): 255-273, 1995; Navab et al., in "Single Point Active Alignment Method (SPAAM) for Calibrating an Optical See-through Head Mounted Display", Proc. of the IEEE International Symposium on Augmented Reality, ISAR '00, Munich, Germany, October 2000; Sauer et al., "Augmented Workspace: Designing an AR Testbed", Proc. of the IEEE International Symposium on Augmented Reality, ISAR '00, Munich, Germany, October 2000; Poston et al., Dextrous Virtual Work, May 1996, Communication of the ACM, vol. 39, No. 5, pp. 37-45; and Koller et al., Real-time Vision-Based Camera Tracking for Augmented Reality Applications, ACM, 1997, pp. 87-94; Billinghurst et al., The Expert Surgical Assistant: An Intelligent Virtual Environment with Multimodal Input, Proceedings of Medicine Meets Virtual Reality IV, pp. 590-607.

Figure 42:
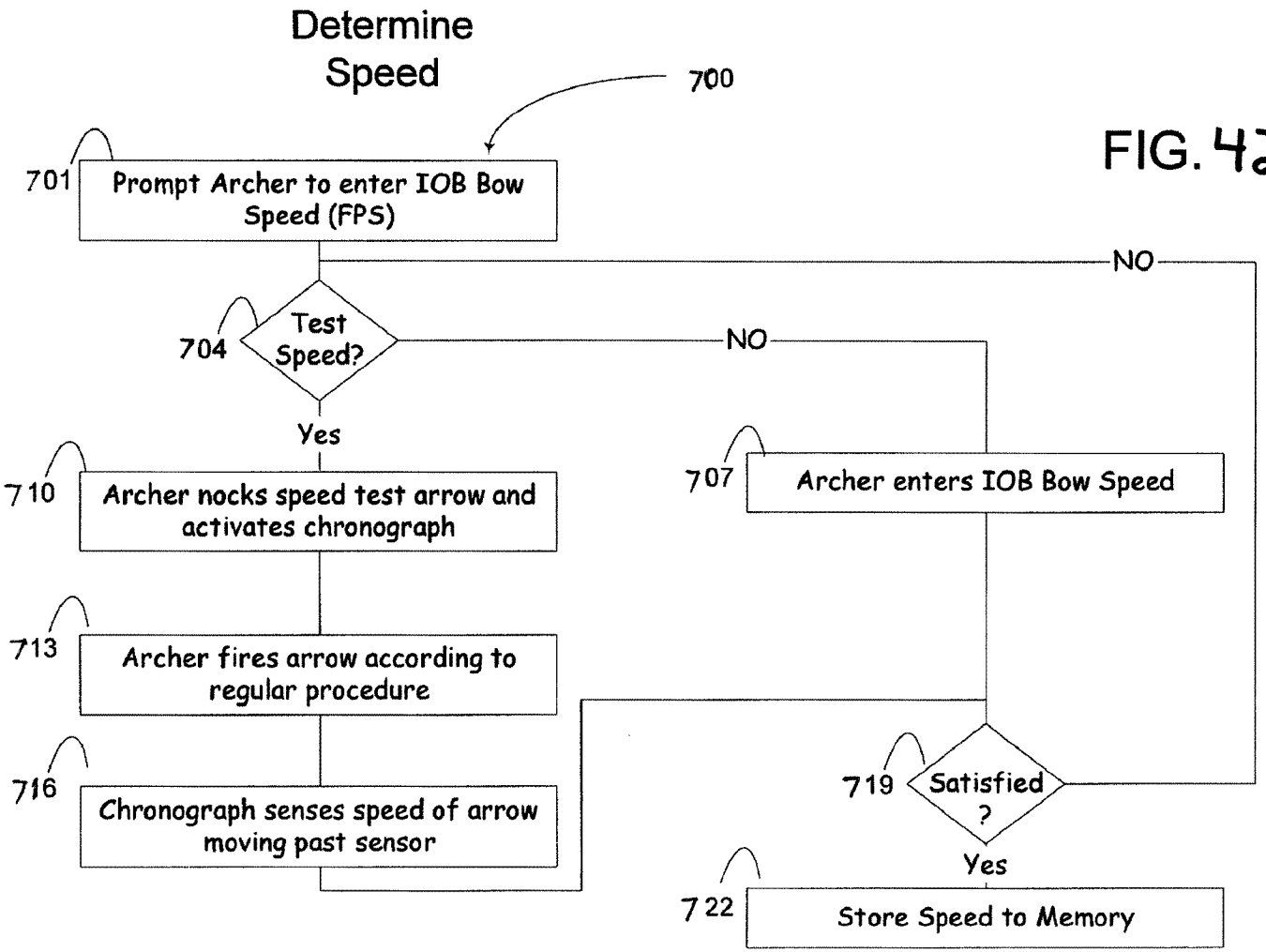
FIG. 42 is a flow chard of a method of determining a bow speed of a bow and archer.
Figure 43:
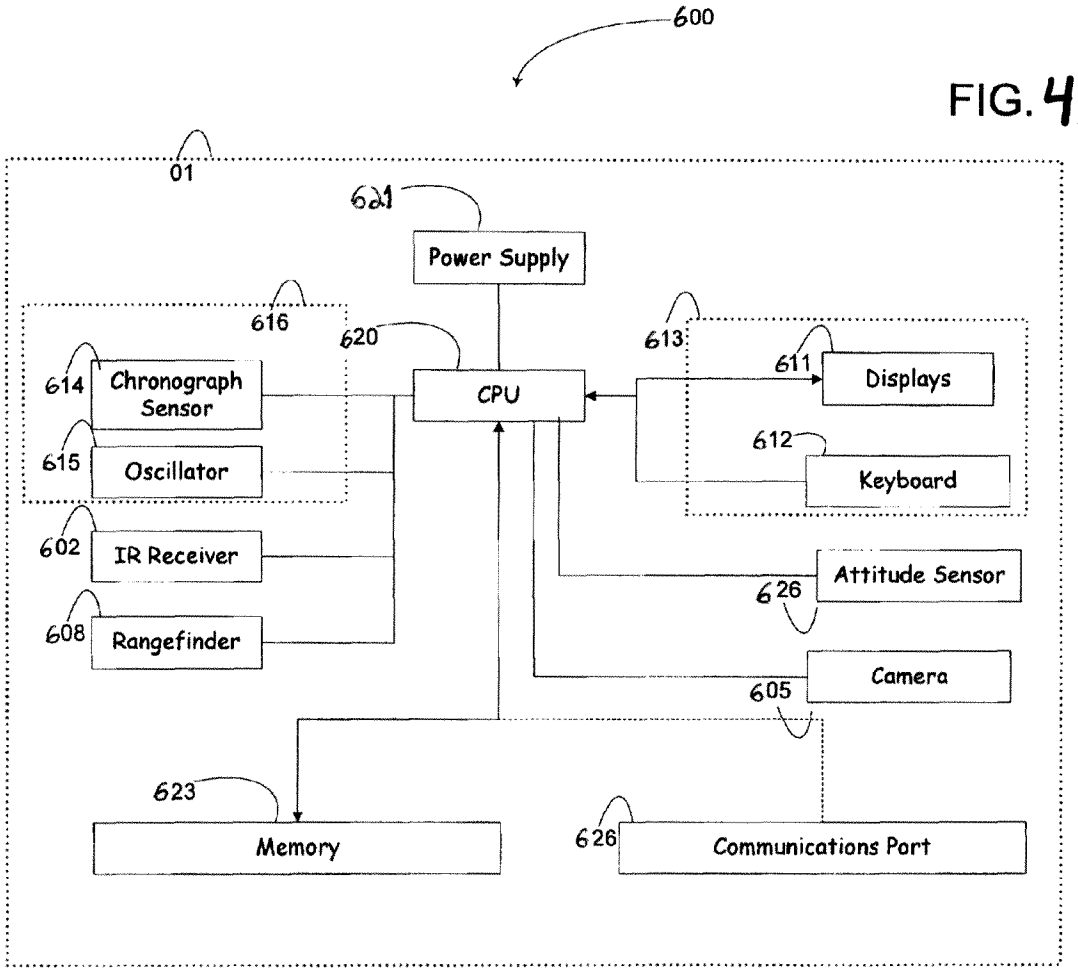
FIG. 43 is a block diagram of the embodiment of the sighting system.

Referring now to FIGS. 42 and 43, a method 700 of setting up the system 600 is presented. The system 600 is housed in a housing 601 and as previously discussed on the exterior of the housing, there are mounted a rangefinder 608, an IR receiver 602, and, optionally, a camera 605 (where the heads up display is embodied by a transparent OLED display, the camera is not necessary to generate an augmented reality display), a chronograph sensor 614, and a display 611.

In the presently preferred embodiment, the display is a touch screen 613 such that the display 611 also fulfills the keyboard 612 functionality. The touch screen display 613 is one option for providing a hardware interface between the user and the system 600. Control wheels, jog wheels, trackballs, and joysticks might also be used in concert with or in lieu of the keyboard 612 to fulfill the inputting function. In some embodiments of the system 600, the display 611 is a plurality of displays. For purposes of explanation of these several embodiments of the system 600, the discussion of the one or more of the plurality of the displays 611 and the user interaction with the keyboard 612, will be set forth by way of nonlimiting exemplary embodiment using the touch-sensitive screen assembly or touch screen 613 as comprising both the keyboard 612 and the display 611 of the user hardware interface.

Within the housing, there are, additionally a central processor 620 connected to memory, an oscillator 615 to provide a time hack to the chronograph sensor 614 to provide the function of the chronograph 616, an attitude sensor 626 to detect the attitude of the system relative to level, and a power supply 621. In an embodiment, there is additionally a communications port 623 that might either be a hardware port such as a Uniform Serial Bus (USB) port or a radio communications port such as a Bluetooth™ port. In either regard, the port allows communication with the system, either for downloading data accumulated in memory 623 during use or for uploading information such as firmware updates to the memory 623. Each of these components will be referred to throughout the explanation of the method 700 of using the system 600 and are provided here to better define the interaction of the hardware components.

As an arrow shot from a bow is essentially a ballistic projectile. As such, the single biggest variable in performance of the bow will be the speed at which the arrow leaves the bow. Generally speaking the 300 fps mark seems to be the benchmark for high performance in the archery market. As a matter of consumer perception, a bow that shoots under 300 fps is generally considered slow, while a bow that shoots over 300 fps considered fast. Manufacturers generally rate their bows using the same IBO (International Bowhunting Organization) Standard. To get an accurate IBO Speed rating, manufacturers must test their bows under the same preset conditions: setting the bow for exactly 70# Peak Draw Weight, exactly 30" Draw Length, and they must shoot a test arrow that weighs precisely 350 grains. This levels the playing field on basic settings, so the differences in IBO scores reflect other design attributes (brace height, cam aggressive, bow efficiency, etc.).

Stated speed is not, however, the speed at which a particular archer using a particular bow to fire a particular arrow. Habits of an archer affect the speed. On the most basic level, there are three main components of actual arrow speed: draw weight, draw length, and arrow mass. The higher the draw weight—the faster the arrow will shoot. The longer the draw length—the faster the arrow will shoot. And the lighter the arrow—the faster it will go. So for the purposes of testing, a slick manufacturer could setup a particular model bow and establish their bow's advertised speed using an unrealistic 100# draw weight, 32" draw length, and shoot an anorexic 250 grain arrow. None of this helps to determine what this particular archer can do.

For this purpose, the method 700 commences at a block 701 where the processor 620 generates a prompt on the display 611 to the user to enter a bow speed. The user may either enter a known bow speed, based upon the user's own experience with the bow, through the keyboard 612 or elect to test the speed using the chronograph 616 and elects to do so at a block 704. Should the archer elect not to test the bow speed, the archer enters the speed, by means of the keyboard 612 at a block 707. Once stored, the element of speed is now configurably stored until the archer elects to retest the speed.

Figure 44:
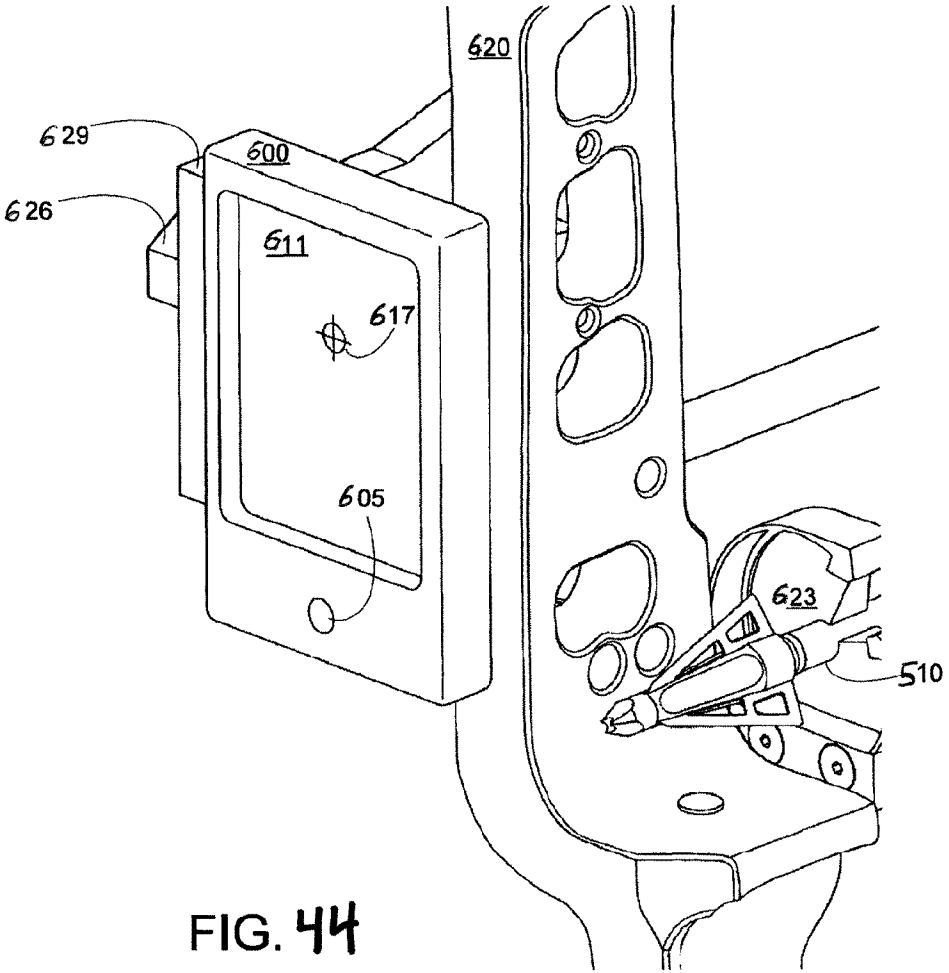
FIG. 44 is a perspective view of the arrow, the system, a mount and a bow in use.
Figure 45:
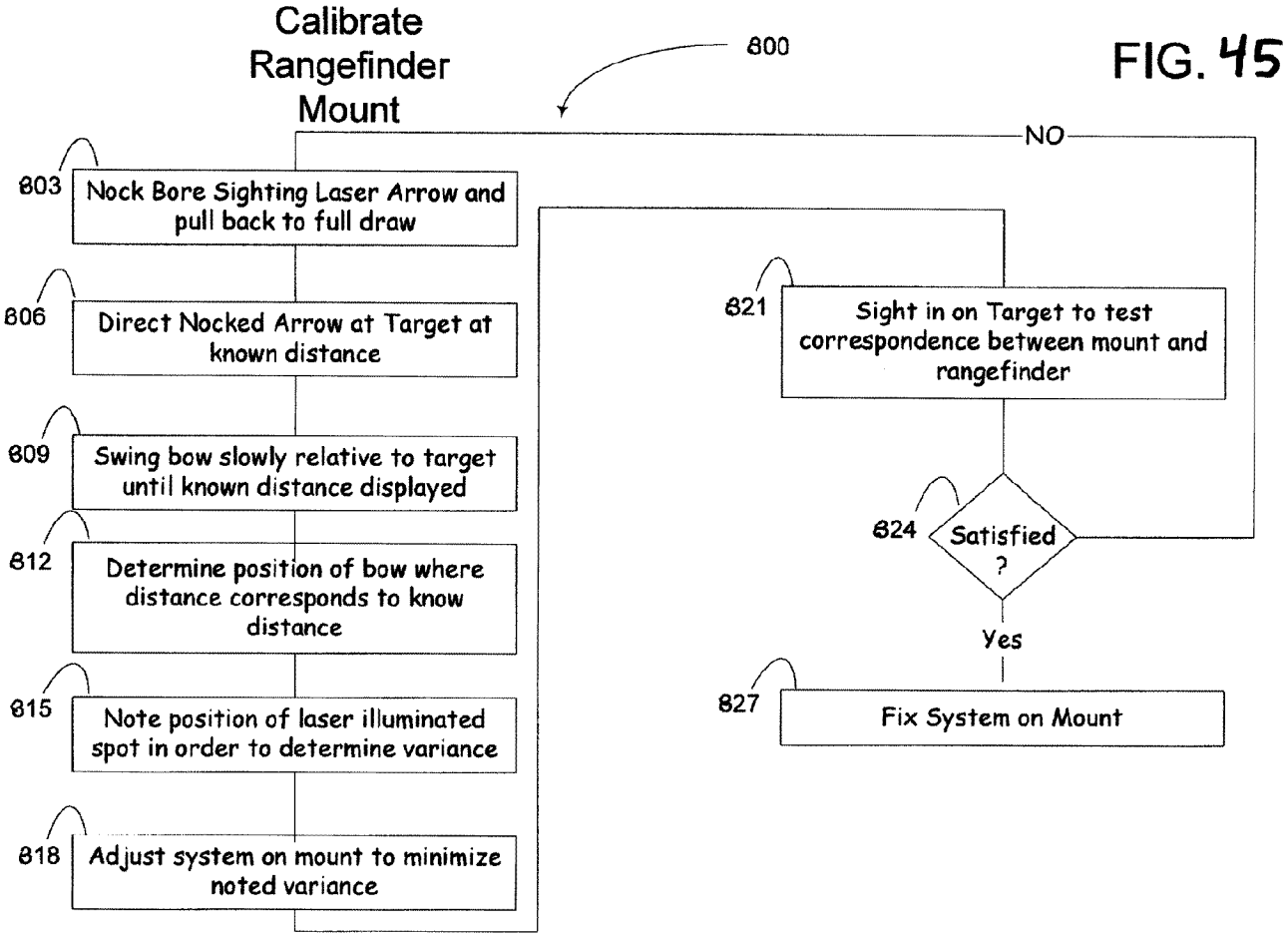
FIG. 45 is a flow chart of a method for calibrating a range finder mount.

Referring to FIGS. 43, 44, and 45, the system 600 is mounted on the bow 620 and fixing of the system 600 on the mount 626 is suitably achieved by the mount calibration method 800. The efficacy of the system 600 relies upon a fixed spatial relationship between the system's 600 rangefinder 608 and the ballistic weapon itself, such as the bow 620. Generally, this is achieved by a rigid mount 626 and a gimbal 626 with two-axis adjustment capability. Exploiting the two-axis adjustment capability, the method 800, tightly relates the position of the system 600 relative to the bow 510 by iterative searching for a target at a known distance.

The housing 601 is fixed to the mount 626 in the archer's best approximation of suitable alignment relative to the bow 620 and arrow rest 623. Once mounted, the archer will now fine tune the mount in accord with the mount 626 calibration method 800.

At a block 803, the archer nocks the bore sighting laser arrow 510 and draws the bow to full draw in accord with the archer's regular recurrent pattern of shooting. As with any form of shooting, repetition with precise accuracy is the key. The United States Marine Corps teaches this using the Breathe, Relax, Aim, Slack, Squeeze (or B.R.A.S.S. for short) in Primary Marksmanship instruction. One of the major goals of this technique is to achieve the proper mindset for taking a shot at a target. Practicing these steps repetitively leads to consistency in performance. The archer at this block is to pull the arrow back as the archer does as consistently with the archer's normal shooting either on the range or in the field.

Figure 47:
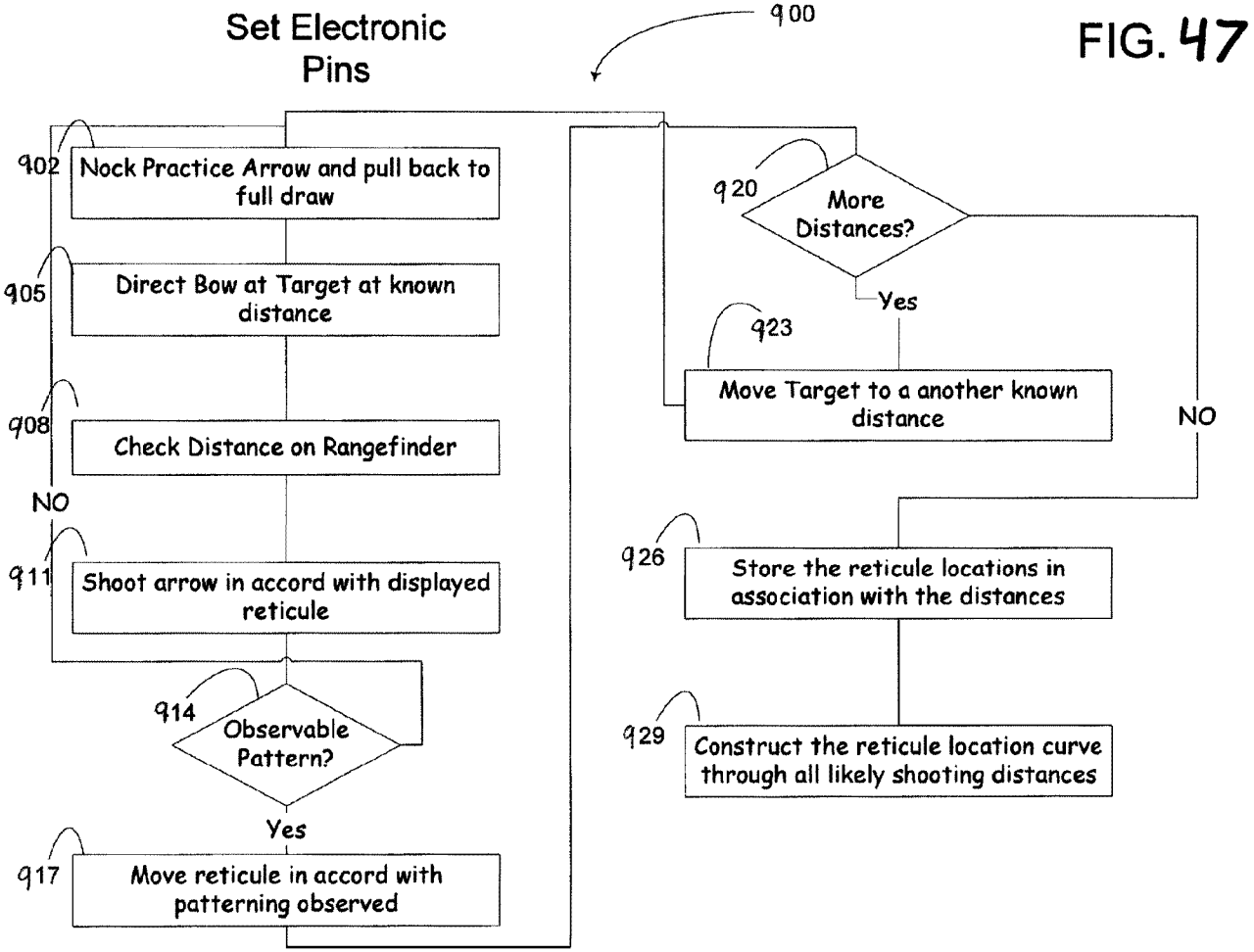
FIG. 47 is a flow chart of a method for setting electronic pins in an embodiment of the sighting system.

Similarly the archer, at a block 806, sights in on a known target in accord with the system 600 in its state without stored reticule locations (storing is discussed in association with FIG. 47 below). The archer directs the bore sighting laser arrow 510 such that the arrow 510 projects a laser dot on a target at a known distance. In most instances, the known distance is generally selected to be 20 yards though any selectable distance can be used as the convention. Among archers, 20 yards is generally selected to be the reference point known as "point blank." In external ballistics, point-blank range is the distance between an archer and a target of a given size such that the arrow in flight is expected to strike the target without adjusting the elevation of the bow. The point-blank range will vary with the bows and an arrow's particular ballistic characteristics, as well as the target chosen. At the block 806, the resulting position of the bow at full draw relative to the target should be aligned with the target at the point blank range. What remains in the method 800 is to align the system 600 on its mount with the bow and the bore sighting laser arrow 510 as it is projecting the laser dot on the target. This same block 806 position is achieved at a step 821 and a step 908 each discussed below.

At a block 809, the archer observes the indicated distance on the rangefinder 608 as shown on the display 611. If the rangefinder and the known distance agree, the archer has achieved the suitable mounting and there is no reason to further perform the method 800 for calibrating the position of the housing 601 relative to the bow on the mount.

Where the distance does not agree, the archer will begin a seek for the target by swinging the bow relative to the target to find the precise position necessary in order to make the rangefinder distance correspond to the known distance. The precise position of the housing 601 relative to the target is found at a block 812. In most instances, if the archer has suitably aligned the housing relative to the target, the precise block 812 position necessary will not be a great departure from the block 806 position. While in the precise block 812 position, the archer notes the second position of the laser dot relative to the target. The archer observes the vector that represents the displacement of the laser dot from the block 806 position to the 812 position at a block 815. At a block 818, the archer adjusts the mount in accord with the vector that represents the displacement of the laser dot from the block 806 position to the 812 position at a block 815. Once adjusted, at a block 821, the archer again sights in on the target as in the block 806. At a block 824, the archer observes whether the rangefinder distance now corresponds to the known distance. If, at the block 824, the archer is satisfied, the archer then locks the housing on the mount relative the bow at a block 827. If the archer is not satisfied at the block 824, the method 800 is iterated to further fine tune the position of the housing 601 relative to the bow until at the block 824, the archer is satisfied and progresses to the block 827 to fix the housing relative to the bow.

Once the housing 601 is fixed relative to the bow in accord with the method 800, the archer will advantageously place electronic pins for known distances and in accord with the distance stored in accord with the method 700 at the block 722. In conventional sighting of a bow, the fixed pin sight is the most common and the more popular choice among bowhunters. A fixed pin sight usually has 3-5 individual pins, and each pin can be set for a particular distance. The top pin for the closest distance and the bottom pin for the furthest distance. Once set they remain fixed in a particular position.

In conventional use of the fixed pin sights, the set up and adjustments on a fixed pin are pretty simple, but at the same time requires a little trial and error to get the perfect setting. Most archers will set this type of sight at easy to remember distances like 5 or 10 yards and once set, shooting one of the set distances is a very easy. The challenging part comes when shooting an unknown distance, where an archer must extrapolate a position between two bracketing distances based upon an estimate of the distance to the target. There are many variables that come into play here, uneven ground, an elevated position and dense foliage.

The inventive sight will extrapolate the distance based upon the rangefinder distance as the mount has been suitably fixed relative to the bow at the block 827. In the method 900, the archer will establish at least a first known reticule position based upon a first known target distance and a second known reticule position based upon a second known distance. The purpose of the first known reticule position and the second known reticule position is to establish for a standard arrow flying in still air at a known temperature, the characteristic flight path. Once known, the invention can suitably extrapolate a reticule position based upon distances distinct from either the first known target distance and the second known target distance. As discussed below, the processor 620 can use statistical methods to vary a reticule position based upon variations in arrows, angle of a line from the bow to the target relative to a horizon, a wind speed vector, or an ambient air temperature.

The archer nocks a first practice arrow and extends to full draw at a block 902. As at the block 806, the archer directs the bow at the target at a block 905. As an optional step, the archer, may, at a block 908, check the rangefinder as the distance is shown on the display 611 for correspondence with the known distance. At a block 911, the archer shoots the practice arrow at the target, for effect in accord with an unmodified reticule positioned in accord with the known distance. The purpose is to find out where the archer shoots arrows when shooting in accord with the reticule as currently positioned in its "factory default" position.

The archer will iterate the shooting of practice arrows until at a block 914, the archer is satisfied that the shot arrows are arrayed in a suitable pattern. Referring to FIG. 46, a pattern 915 is noted as the arrows are arrayed in a target 916. As with the displacement of the laser dot, the archer noted at the block 815, the archer now observes the vector that represents the displacement of the pattern from the center of the target to where the unshifted reticule directs the archer to shoot. At a block 917, the archer adjusts the reticule position in accord with the vector that represents the pattern as shot according the reticule position, from the center of the target.

The archer iterates the process from the block 902 to block 917 for a number of selected distances at the block 920. Once collected, the several reticule positions represent a curve in space where an x- and y-axis reticule position displacement is a function of distance. The processor 620 smoothly constructs, using known statistical methods, that curve through all usable distances of the bow at a block 929. Given that constructed curve, the reticule in use is positioned for the archer based upon the rangefinder distance to target.

Figure 48C:
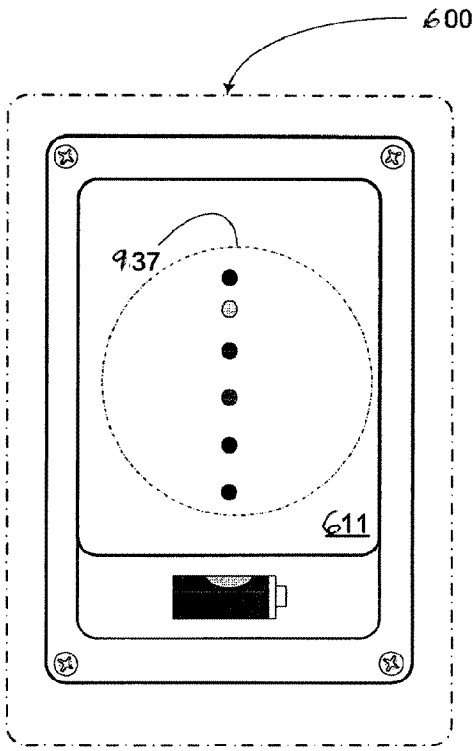
FIGS. 48*a*, 48*b*, and 48*c* are exemplary displays that illustrates various operating modes of the sighting device, in one nonlimiting embodiment.
Figure 48B:
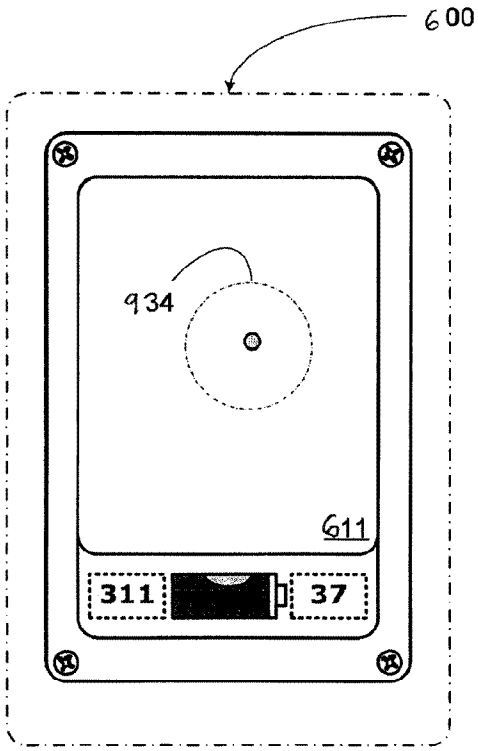
Figure 48A:
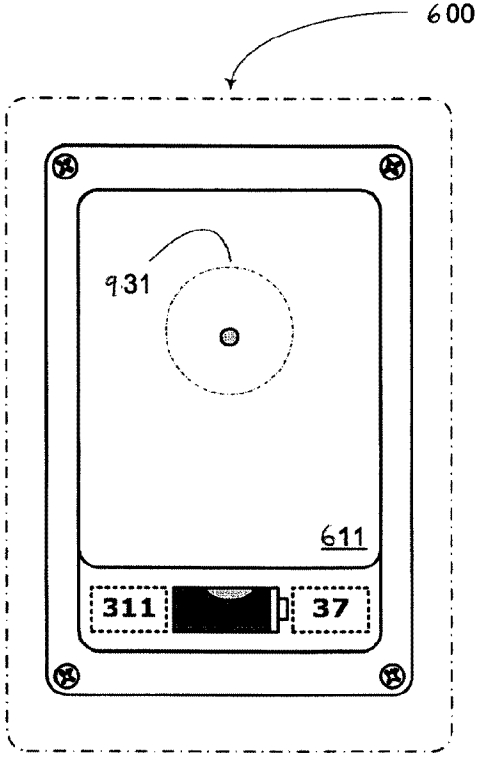

Referring now to FIGS. 48*a*, 48*b*, and 48*c*, the system 600 can generate a number of distinct reticule patterns once the correction curve is constructed at the block 929. Because each type of arrowhead commonly used by the archer has a known effect upon the flight of the arrow, and indeed, different shaft weights will likewise affect flight of an arrow once the nominal flight path has been established at the block 929. Thus, when the archer informs the system of an arrow configuration, the archer intends to use, the system can adjust the position of the reticule based upon that arrow configuration. Common means of informing the system might include optical patterns such as bar codes read at the system 100 or an RFID tag implanted upon the arrow, or by more conventional means such as inputting the arrow type on the keyboard 612. Thus, in FIG. 48*a* a reticule 931 is displayed for the use of field points. Contrast that to the positioning of a reticule 934, the processor 620 generates in response to the selected use of hunting broadheads. At the archer's option, or in the event that the rangefinder cannot locate the proper distance to the target as shown in FIG. 48*c*, the processor 620 will generate the uncorrected traditional pin series in a reticule 937.

The system may include variations in addition to those described herein. Those of ordinary skill in the art will recognize numerous modifications and substitutions that can be made to the components described herein to achieve similar results. While the preferred embodiment of the invention has been illustrated and described, as noted above, many changes can be made without departing from the spirit and scope of the invention.

In alternate embodiments, the processor 620 turns the camera 605 turns off after an optional proximity sensor has not detected an arrow for a certain period (e.g., 10 seconds). The system 600 may also include an attitude sensor that automatically adjusts the reticule based on the distance and slope (incline or decline) sensed at an attitude sensor 626 that indicates the slope of a path from the archer to the target.

In still another alternative embodiment, the camera is also used to collect video clips or photos of targets shot in time relative to the release of the arrow. Exploiting the range finder, the processor 620 may also automatically adjusts the zoom of the camera 605 as the objective lens is set according to distance; a more complex objective lens can also be autofocused in accord with the distance sensed at the rangefinder.

The processor 620 can be configured to modify the image generated on the display 611 such that the archer can select what data to view on the lower portion of the sighting system. Programmable buttons are also possible through processor 620 configuration of a touch screen display 613. For example, the touch screen display 613 is capable of displaying various information such as FPS, distance to the target (e.g., in yards or meters), and a battery life indicator as well as a digital level. The touch screen display 613 may also be optionally configured to include a digital compass, barometer, thermometer, wind direction, and wind speed. Each of these has a known effect upon the arrow and no new algorithm is set forth here for reckoning that effect. Nonetheless, the processor 620 is configured to suitably displace the reticule 617 upon the display 611 relative to each of these factors individually or the factors in concert. In one embodiment, the characterizing of the bore sighting laser arrow 510 in flight is additionally based on accelerometer reading transmitted to the system by IR/LED transmitter 518.

In further embodiments, the system 600 may include a remote wired or wireless button that the archer can attach to the grip of the bow or other convenient location and may use it to augment the keyboard. Thus, in this exemplary embodiment, when the archer presses the button, the range finder 608 scans for distance. Once the archer releases the button 513, the range finder 608 will "lock," and in response, the system 600 will display an reticule based on the correct distance to the target, and, in a further embodiment, the camera 605 will begin capturing video.

Throughout this application, reference is made to the sport of archery and this sighting system is described to include a bow and an arrow. There is nothing that limits the use of the sighting system to archery applications. It is envisioned that, for example, the same system might be used to aim a rifle or handgun; automatic weaponry, such as an automatic rifle; or even a cross-bow. The archery example has been selected as a non-limiting means of explaining more universal principles that are shared in use on any ballistic weapon. For example, the relation of the mount to the sighting system and thus to the weapon is the same whether the weapon is a black-powder rifle or, as here, a bow. Bore-sighting is, likewise, bore-sighting whether on a rifle or, as here, on a bow. This invention is not, therefore, limited to archery applications.

The above disclosure is related to the detailed technical contents and inventive features thereof. People skilled in this field may proceed with a variety of modifications and replacements based on the disclosures and suggestions of the invention as described without departing from the characteristics thereof. For example, the invention is also applicable to cross bows, spear fishing guns and other projectiles that would benefit from a laser aiming pointed tip. Nevertheless, although such modifications and replacements are not fully disclosed in the above descriptions, they have substantially been covered in the following claims as appended.

What is claimed is:

1. An arrowhead, comprising:
- a body;
- a plurality of blades extending outwardly from the body; and
- a tip extending forwardly from the body, the tip defining a center axis and including:
  - a first tip point;
  - a second tip point;
  - a first cutting edge disposed between the first tip point and the second tip point;
  - an aperture defined in the tip along the center axis of the tip; and
  - a plurality of facets, wherein the plurality of facets includes at least two different facet sizes.

2. The arrowhead of claim 1, wherein the tip is detachable from the body and the tip has a longitudinal length.

3. The arrowhead of claim 2, wherein the aperture extends through the entire longitudinal length of the tip.

4. The arrowhead of claim 2, wherein the tip is threaded onto the body.

5. The arrowhead of claim 1, wherein the tip includes a third tip point and a second cutting edge is disposed between the second tip point and the third tip point.

6. The arrowhead of claim 5, wherein a third cutting edge is defined between the third tip point and the first tip point.

7. The arrowhead of claim 1, wherein the plurality of facets are arranged radially about an outer circumferential surface of the tip.

8. The arrowhead of claim 1, wherein each facet includes a first beveled portion, a second beveled portion, and a planar portion disposed between the first and second beveled portions.

9. The arrowhead of claim 1, wherein the body includes a plurality of grooves defined in the body that are oriented along the longitudinal length of the body, and wherein an edge of each of the plurality of blades is disposed in a respective one of the plurality of grooves.

10. The arrowhead of claim 9, wherein each of the plurality of facets lies radially between two adjacent grooves of the plurality of grooves.

11. The arrowhead of claim 1, wherein there are an equal number of blades and tip points, and wherein there are at least as many cutting edges as tip points.

12. The arrowhead of claim 1, wherein the body defines an internal cavity and an electronic component is disposed within the internal cavity.

13. The arrowhead of claim 12, wherein the electronic component is a laser diode, the laser diode arranged so that the laser beam emitted by the diode projects forward from the arrowhead through the aperture in the tip, the laser beam being coaxial with the center axis of the tip.

14. An arrow system, comprising
- an arrow shaft comprising a first end and a second end; and
- an arrow head coupled to an end of the arrow shaft, the arrow head comprising:
  - a body;
  - a plurality of blades extending outwardly from the body; and
  - a tip extending forwardly from the body, the tip defining a center axis and including:
    - a first tip point;
    - a second tip point;
    - a first cutting edge disposed between the first tip point and the second tip point;

an aperture defined in the tip along the center axis of the tip; and a plurality of facets, wherein the plurality of facets includes at least two different facet sizes.

15. The arrow system of claim 14, further comprising a lightable nock coupled to the second end of the arrow shaft.

16. The arrow system of claim 14, wherein the tip is removable from the body and is coupled to the body with screw threads.

17. The arrowhead of claim 14, wherein the tip is removable and defines a longitudinal length, and wherein the aperture extends through the entire longitudinal length of the tip.

18. A hollow tip and multi-point broadhead, comprising:

a body comprising a first end and a second end; and a removable tip portion, including a first end, an opposing second end, a longitudinal length extending between the first and second ends and a center axis along the longitudinal length, wherein the first end of the tip portion is coupled to the body, wherein an aperture is defined in the tip portion, the aperture extending inwards from the second end of the tip portion towards the first end of the tip portion and along the center axis, and wherein the tip portion includes:

a first tip point;

a second tip point;

a first cutting edge disposed between the first tip point and the second tip point; and a first facet defined in the tip portion having a radiused first facet surface contour.

19. The arrow system of claim 18, wherein the tip portion is coupled to the body with screw threads.

20. The arrow system of claim 18, wherein the tip includes a second facet having a different surface area than the first facet.

* * * * *